US008985574B2

(12) United States Patent
Yoshida

(10) Patent No.: US 8,985,574 B2
(45) Date of Patent: Mar. 24, 2015

(54) IMAGE FORMING APPARATUS

(71) Applicant: KYOCERA Document Solutions Inc., Osaka-shi (JP)

(72) Inventor: Takeshi Yoshida, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/062,250

(22) Filed: Oct. 24, 2013

(65) Prior Publication Data

US 2014/0049001 A1 Feb. 20, 2014

Related U.S. Application Data

(62) Division of application No. 13/425,291, filed on Mar. 20, 2012, now Pat. No. 8,579,282.

(30) Foreign Application Priority Data

Mar. 23, 2011 (JP) ..... 2011-064747

(51) Int. Cl.
*B65H 31/00* (2006.01)
*B65H 31/20* (2006.01)
(Continued)

(52) U.S. Cl.
CPC ..... *B65H 31/20* (2013.01); *B65H 2405/1112* (2013.01); *B65H 31/02* (2013.01); *B65H 31/26* (2013.01); *B65H 2405/1111* (2013.01); *B65H 2801/06* (2013.01)
USPC ..... 271/207; 271/209; 271/220

(58) Field of Classification Search
CPC ..... B65H 31/26; B65H 2405/111; B65H 2405/1112; B65H 2405/1113; B65H 2405/1114
USPC ..... 271/207, 209, 220
See application file for complete search history.

(56) References Cited

U.S. PATENT DOCUMENTS 4,061,331 A * 12/1977 Habich ..... 271/223
4,898,374 A 2/1990 Vermaat
2002/0079642 A1 * 6/2002 Tamura et al. ..... 271/207
(Continued)

FOREIGN PATENT DOCUMENTS

JP 59-057425 U 4/1984
JP 64-24064 U 2/1989
(Continued)

OTHER PUBLICATIONS

Notice of Reasons for Rejection issued to Japanese Application No. 2011-064747, mailed Jun. 18, 2013.

*Primary Examiner* — David H Bollinger
(74) *Attorney, Agent, or Firm* — Knobbe Martens Olson & Bear LLP

(57) ABSTRACT

An image forming apparatus includes a housing, an image forming unit disposed inside the housing, a discharging portion, a stacking unit and a pressing member. The discharging portion is configured to discharge a sheet medium on which an image is formed by the image forming unit. The stacking unit is configured to stack the sheet medium discharged from the discharging portion. The stacking unit includes a stacking surface portion on which the sheet medium is stacked. The stacking surface portion includes a planar portion formed flat and a protruding portion configured to protrude upwardly from the planar portion. The pressing member is disposed in contact with an upper surface of the sheet medium stacked on the stacking surface portion.

5 Claims, 14 Drawing Sheets

(51) Int. Cl.
*B65H 31/02* (2006.01)
*B65H 31/26* (2006.01)

(56) References Cited

U.S. PATENT DOCUMENTS

| | | | | |
|---|---|---|---|---|
| 2003/0107166 | A1 | 6/2003 | Cost et al. | |
| 2006/0071413 | A1 | 4/2006 | Kaneko et al. | |
| 2007/0108697 | A1 * | 5/2007 | Tamura et al. | 271/220 |
| 2009/0283961 | A1 * | 11/2009 | Saito et al. | 271/220 |
| 2013/0026703 | A1 * | 1/2013 | Watanabe et al. | 271/220 |

FOREIGN PATENT DOCUMENTS

| | | |
|---|---|---|
| JP | 02-135368 | 5/1990 |
| JP | 07-133050 | 5/1995 |
| JP | 2004-196515 A | 7/2004 |
| JP | 2004-277055 | 10/2004 |
| JP | 2006-89201 A | 4/2006 |

* cited by examiner

IMAGE FORMING APPARATUS

REFERENCE TO RELATED APPLICATIONS

This application is a divisional of U.S. application Ser. No. 13/425,291, filed on Mar. 20, 2012, which claims priority to Japanese Patent Application No. 2011-064747, filed on Mar. 23, 2011, which are hereby incorporated by reference in their entirety.

BACKGROUND

The present disclosure relates to an image forming apparatus such as a copying machine, a printer, a facsimile, or a multifunction peripheral combining such devices.

Conventionally, an image forming apparatus such as a copying machine, a printer, a facsimile or a multifunction peripheral combining such devices has been known as an apparatus for forming (printing) an image on a sheet of paper used as a sheet medium. These types of image forming apparatuses generally include a stacking unit that has a stacking surface portion. Discharged sheets of paper are stacked on the stacking surface portion.

The stacking surface portion must have a length that enables stacking of sheets of paper having maximum length in a direction in which the sheets of paper are discharged from a discharging portion so that these sheets can be stacked on the stacking surface portion. The above requirement is a reason causing an increase in the overall size of the image forming apparatus.

In this regard, a plurality of image forming apparatuses has been proposed that enables an increase in the surface area of a stacking surface portion to deal with large-size sheets of paper. One of such image forming apparatuses is configured to rotate a folded auxiliary tray. In this manner, the surface area of the stacking surface portion can be increased. Furthermore, one of such image forming apparatuses is configured so that a folded auxiliary tray is raised in operable connection with mounting of a sheet feeding cassette, when the sheet feeding cassette containing large-size sheets of paper is mounted in a main cabinet. In this manner, the surface area of a stacking surface portion can be increased.

SUMMARY

However, when large-size sheets of paper are stacked on the stacking surface portion, the image forming apparatuses described above are configured to rotate or raise the auxiliary tray. Therefore, these types of image forming apparatuses result in an increase in the required surface area (volume) outside the apparatus.

Consequently, there has been a demand for an image forming apparatus including a stacking unit that is configured to inhibit an increase in the apparatus size for a case where large-size sheets of paper are stacked on a stacking surface portion.

The present disclosure provides an image forming apparatus that includes a stacking unit that is configured to inhibit an increase in the apparatus size.

The present disclosure provides an image forming apparatus, which includes a housing, an image forming unit disposed inside the housing, a discharging portion, a stacking unit and a pressing member. The discharging portion is configured to discharge a sheet medium on which an image is formed by the image forming unit. The stacking unit is configured to stack the sheet medium discharged from the discharging portion. The stacking unit includes a stacking surface portion on which the sheet medium is stacked. The stacking surface portion includes a planar portion formed flat, and a protruding portion configured to protrude upwardly from the planar portion and/or a recessed portion configured to be indented downwardly at the planar portion. The pressing member is disposed in contact with an upper surface of the sheet medium stacked on the stacking surface portion.

The present disclosure provides the image forming apparatus that includes the stacking unit that is configured to inhibit an increase in the apparatus size.

DETAILED DESCRIPTION

A first embodiment of a copying machine 1 will be described below as an example of an image forming apparatus according to the present disclosure making reference to the figures.

Figure 1:
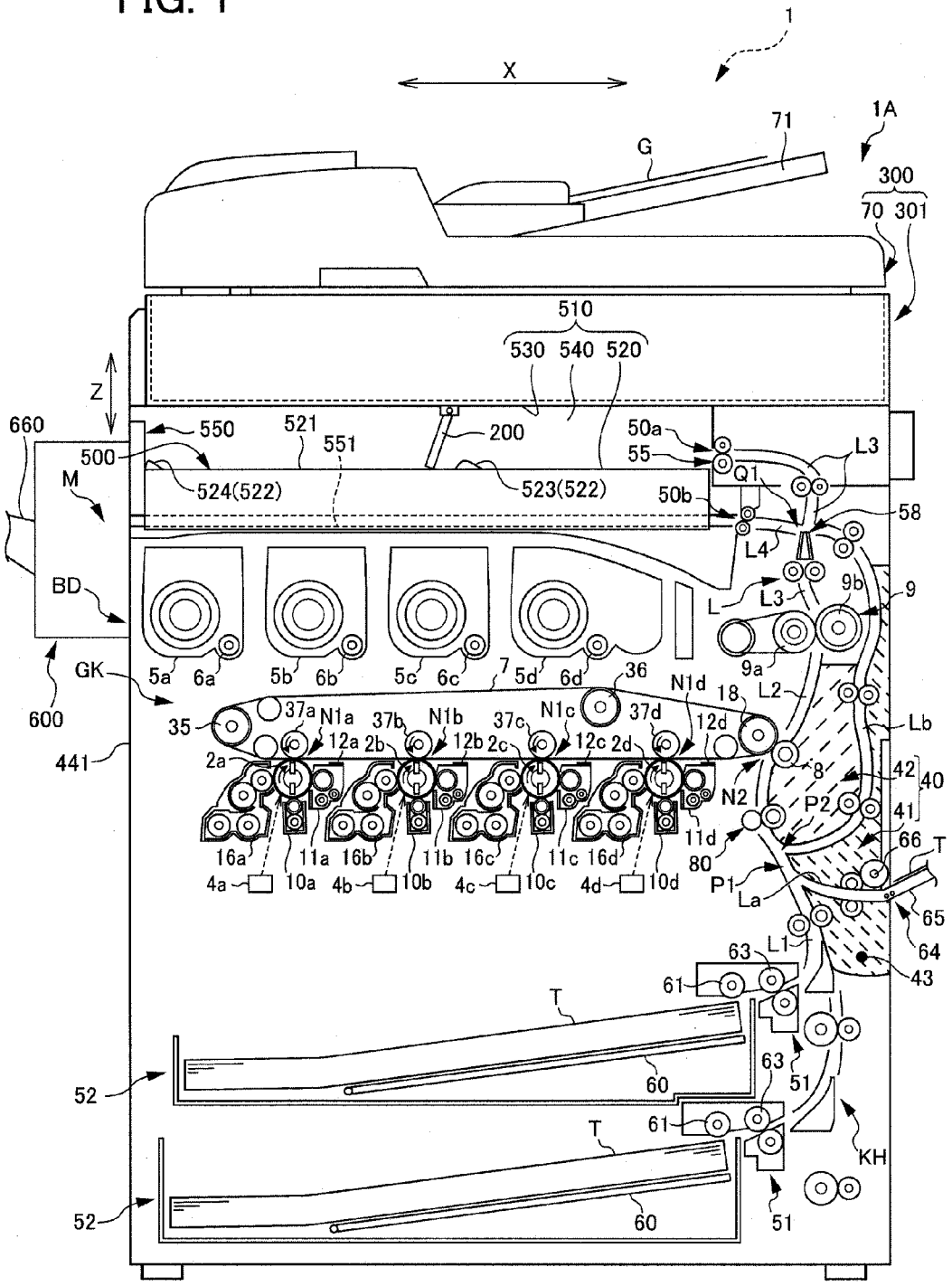
FIG. 1 illustrates the disposition of each constituent element in a copying machine 1 according to a first embodiment of the present disclosure.

FIG. 1 illustrates the disposition of each constituent element in the copying machine 1 according to the first embodiment of the present disclosure.

As illustrated in FIG. 1, the copying machine 1 representing the first embodiment of the present disclosure includes a main cabinet M, an image reading device 300, a relay unit 500, and a post-processing device 600. The image reading device 300 is attached to a top portion of the main cabinet M. The relay unit 500 is attached to the main cabinet M. The post-processing device 600 is attached to the main cabinet M.

As illustrated in FIG. 1, the relay unit 500 and the post-processing device 600 are optionally attached to the main cabinet M of the copying machine 1.

The image reading device 300 is disposed on an upper end portion of the copying machine 1 in a vertical direction Z. The image reading device 300 reads an image of a document. The image reading device 300 outputs image information related to the read image to the main cabinet M (image forming unit).

The main cabinet M uses the image information sent from the image reading apparatus 300 to form a toner image on a sheet of paper T, which is an example of a sheet medium. The sheet medium is a recording medium shaped like a sheet on which an image is formed. The sheet medium includes a recording medium such as paper or the like.

In the description of the copying machine 1, a secondary scanning direction X illustrated in FIG. 1 is also denoted as a "left-right direction" of the copying machine 1, and a main scanning direction Y (refer to FIG. 2) orthogonal to the secondary scanning direction X is also denoted as a "forward-backward direction" of the copying machine 1. The vertical direction Z of the copying machine 1 is orthogonal to the secondary scanning direction X and the main scanning direction Y.

Firstly, the image reading device 300 will be described.

As illustrated in FIG. 1, the image reading device 300 includes an image reading unit 301 and a document feed unit 70. The image reading unit 301 reads an image of a document G. The document feed unit 70 is disposed above the image reading unit 301, and conveys the document G to the image reading unit 301.

The document feed unit 70 is openably and closably connected to the image reading unit 301 by a connecting part (not illustrated). An upper side of the document feed unit 70 includes a document mounting part 71. The document feed unit 70 includes a feed roller (not illustrated) inside of it.

Next, respective portions of the main cabinet M will be described making reference to FIG. 1.

The main cabinet M includes an image forming unit GK and a paper feeding/discharging portion KH. The image forming unit GK uses the image information sent from the image reading apparatus 300 to form a toner image on a sheet of paper T that is an example of a sheet medium. The paper feeding/discharging portion KH feeds a sheet of paper T to the image forming unit GK and discharges the sheet of paper T on which a toner image is formed.

The outer shape of the main cabinet M is configured by a case member BD serving as a housing.

As illustrated in FIG. 1, the image forming unit GK is disposed inside the case member BD. The image forming unit GK includes photoreceptor drums 2*a*, 2*b*, 2*c*, and 2*d* as image bearing members (photoreceptors), charging portions 10*a*, 10*b*, 10*c*, and 10*d*, laser scanner units 4*a*, 4*b*, 4*c*, and 4*d* as exposure units, developing units 16*a*, 16*b*, 16*c*, and 16*d*, toner cartridges 5*a*, 5*b*, 5*c*, and 5*d*, toner feeding portions 6*a*, 6*b*, 6*c*, and 6*d*, drum cleaning portions 11*a*, 11*b*, 11*c*, and 11*d*, static eliminators 12*a*, 12*b*, 12*c*, and 12*d*, an intermediate transfer belt 7, primary transfer rollers 37*a*, 37*b*, 37*c*, and 37*d*, a secondary transfer roller 8, an opposing roller 18, and a fixing unit 9.

The paper feeding/discharging portion KH includes a paper feeding cassette 52, a manual feeding portion 64, a paper path L for a sheet of paper T, a pair of registration rollers 80, a first discharging portion 50*a*, and a second discharging portion 50*b*. It should be noted that the paper path L is an assembly of a first paper path L1, a second paper path L2, a third paper path L3, a manual paper path La, a reverse paper path Lb, and a fourth paper path L4 as described hereafter.

Constituent components of the image forming unit GK and the paper feeding/discharging portion KH will be described in detail hereinafter with reference to FIG. 1.

First, a description is provided for the image forming unit GK.

In the image forming unit GK, such operations are performed in sequence on surfaces of the photoreceptor drums 2*a*, 2*b*, 2*c* and 2*d* in sequence from upstream to downstream as charging by the charging portions 10*a*, 10*b*, 10*c* and 10*d*, exposure by the laser scanner units 4*a*, 4*b*, 4*c* and 4*d*, development by the developing units 16*a*, 16*b*, 16*c* and 16*d*, primary transfer by the intermediate transfer belt 7 and the primary transfer rollers 37*a*, 37*b*, 37*c* and 37*d*, static elimination by the static eliminators 12*a*, 12*b*, 12*c* and 12*d*, and cleaning by the drum cleaning portions 11*a*, 11*b*, 11*c* and 11*d*.

In addition, secondary transfer by the intermediate transfer belt 7, the secondary transfer roller 8 and the opposing roller 18, and fixation by the fixing unit 9 are performed in the image forming unit GK.

Each of the photoreceptor drums 2*a*, 2*b*, 2*c*, and 2*d* is composed of a cylindrically shaped member and functions as a photoreceptor or an image bearing member. Each of the photoreceptor drums 2*a*, 2*b*, 2*c*, and 2*d* is disposed so as to be rotatable in a direction of an arrow, about a rotational axis that extends in a direction orthogonal to a direction of movement of the intermediate transfer belt 7. An electrostatic latent image is formed on a surface of each of the photoreceptor drums 2*a*, 2*b*, 2*c*, and 2*d*.

Each of the charging portions 10*a*, 10*b*, 10*c*, and 10*d* is disposed so as to face the surface of each of the photoreceptor drums 2*a*, 2*b*, 2*c*, and 2*d*. Each of the charging portions 10*a*, 10*b*, 10*c*, and 10*d* applies a uniform negative charge (negative polarity) or positive charge (positive polarity) to the surface of each of the photoreceptor drums 2*a*, 2*b*, 2*c*, and 2*d*.

Each of the laser scanner units 4*a*, 4*b*, 4*c*, and 4*d* functions as an exposure unit and is spaced apart from the surface of each of the photoreceptor drums 2*a*, 2*b*, 2*c*, and 2*d*. Each of the laser scanner units 4*a*, 4*b*, 4*c*, and 4*d* is configured to include a laser light source, a polygonal mirror, a polygonal mirror driving motor and the like, which are not illustrated.

Each of the laser scanner units 4*a*, 4*b*, 4*c*, 4*d* scans and exposes the surface of each of the photoreceptor drums 2*a*, 2*b*, 2*c*, 2*d* based on the image information related to the image read by the image reading unit 301. An electric charge of an exposed part of the surface of each of the photoreceptor drums 2*a*, 2*b*, 2*c*, and 2*d* is removed by scanning and exposing performed by each of the laser scanner units 4*a*, 4*b*, 4*c*, and 4*d*. In this way, an electrostatic latent image is formed on the surface of each of the photoreceptor drums 2*a*, 2*b*, 2*c*, and 2*d*.

The developing units 16*a*, 16*b*, 16*c*, and 16*d* are respectively disposed to correspond to the photoreceptor drums 2*a*, 2*b*, 2*c*, and 2*d*, and are disposed to face the corresponding surfaces of the photoreceptor drums 2*a*, 2*b*, 2*c*, and 2*d*. Each of the developing units 16*a*, 16*b*, 16*c*, and 16*d* forms a color toner image on the surface of each of the photoreceptor drums 2*a*, 2*b*, 2*c*, and 2*d* by depositing toner of each color on the electrostatic latent image formed on the surface of each of the photoreceptor drums 2*a*, 2*b*, 2*c*, and 2*d*. The respective developing units 16*a*, 16*b*, 16*c*, and 16*d* correspond to four colors of yellow, cyan, magenta, and black. Each of the developing units 16*a*, 16*b*, 16*c*, and 16*d* is configured to include a developing roller disposed to face the surface of each of the photoreceptor drums 2*a*, 2*b*, 2*c*, and 2*d*, an agitating roller for agitating toner, and the like.

The toner cartridges 5*a*, 5*b*, 5*c*, and 5*d* are provided to correspond to the developing units 16*a*, 16*b*, 16*c*, and 16*d*, respectively. The respective toner cartridges 5*a*, 5*b*, 5*c*, and 5*d* store the toner of different colors supplied to the respective developing units 16*a*, 16*b*, 16*c*, and 16*d*. The toner cartridges 5*a*, 5*b*, 5*c*, and 5*d* store yellow toner, cyan toner, magenta toner, and black toner, respectively.

The toner feeding parts 6*a*, 6*b*, 6*c* and 6*d* are provided to correspond to the toner cartridges 5*a*, 5*b*, 5*c* and 5*d* and the developing units 16*a*, 16*b*, 16*c* and 16*d* respectively, and supply toner of the respective colors stored in the toner cartridges 5*a*, 5*b*, 5*c*, and 5*d* to the developing units 16*a*, 16*b*, 16*c*, and 16*d*, respectively. Each of the toner feeding devices 6*a*, 6*b*, 6*c*, and 6*d* is connected with each of the developing units 16*a*, 16*b*, 16*c*, and 16*d* via a toner feeding path (not illustrated).

Toner images of respective colors formed on the photoreceptor drums 2*a*, 2*b*, 2*c*, and 2*d* undergo primary transfer in sequence onto the intermediate transfer belt 7. The intermediate transfer belt 7 is stretched around a driven roller 35, the opposing roller 18 of a driving roller, a tension roller 36 and the like. Since the tension roller 36 biases the intermediate transfer belt 7 from inside to outside, a predetermined tension is applied to the intermediate transfer belt 7.

Each of the primary transfer rollers 37*a*, 37*b*, 37*c*, and 37*d* is disposed opposite to each of the photoreceptor drums 2*a*, 2*b*, 2*c*, and 2*d* across the intermediate transfer belt 7.

Predetermined parts of the intermediate transfer belt 7 are nipped between the respective primary image transfer rollers 37*a*, 37*b*, 37*c*, and 37*d* and the respective photoreceptor drums 2*a*, 2*b*, 2*c*, and 2*d*. Each of the predetermined nipped parts is pressed against the surface of each of the photoreceptor drums 2*a*, 2*b*, 2*c*, and 2*d*. Primary transfer nips N1*a*, N1*b*, N1*c*, and N1*d* are formed between the photoreceptor drums 2*a*, 2*b*, 2*c*, and 2*d* and the primary image transfer rollers 37*a*, 37*b*, 37*c*, and 37*d*, respectively. At the respective primary transfer nips N1*a*, N1*b*, N1*c*, and N1*d*, toner images of the respective colors developed on the respective photoreceptor drums 2*a*, 2*b*, 2*c*, and 2*d* undergo primary transfer in sequence onto the intermediate transfer belt 7. In this manner, a full-color toner image is formed on the intermediate transfer belt 7.

A primary transfer bias is applied to each of the primary transfer rollers 37*a*, 37*b*, 37*c*, and 37*d* by a primary transfer bias application portion (not illustrated). The primary transfer bias applied by the primary transfer bias application portion causes the toner image of each color formed on each of the photoreceptor drums 2*a*, 2*b*, 2*c*, and 2*d* to be transferred onto the intermediate transfer belt 7.

Each of the static eliminators 12*a*, 12*b*, 12*c*, and 12*d* is disposed so as to face the surface of each of the photoreceptor drums 2*a*, 2*b*, 2*c*, and 2*d*. Each of the static eliminators 12*a*, 12*b*, 12*c*, and 12*d* illuminates light on the surface of each of the photoreceptor drums 2*a*, 2*b*, 2*c*, and 2*d*. In this manner, each of the static eliminators 12*a*, 12*b*, 12*c*, and 12*d* removes charge (eliminates an electrical charge) from the surface of each of the photoreceptor drums 2*a*, 2*b*, 2*c*, and 2*d* after the primary transfer.

Each of the drum cleaning portions 11*a*, 11*b*, 11*c*, and 11*d* is disposed so as to face the surface of each of the photoreceptor drums 2*a*, 2*b*, 2*c*, and 2*d*. Each of the drum cleaning portions 11*a*, 11*b*, 11*c*, and 11*d* removes toner and attached matter remaining on the surface of each of the photoreceptor drums 2*a*, 2*b*, 2*c*, and 2*d*, and conveys the removed toner to a predetermined collection mechanism for collection.

The secondary transfer roller 8 executes secondary transfer of the full-color toner image, which has been primarily transferred to the intermediate transfer belt 7, to a sheet of paper T. A secondary transfer bias is applied to the secondary transfer roller 8 by a secondary transfer bias application part (not illustrated). The secondary transfer bias is applied by the secondary transfer bias application part transfers the full-color toner image formed on the intermediate transfer belt 7 to the sheet of paper T.

The secondary transfer roller 8 comes in contact with and separates from the intermediate transfer belt 7. More specifically, the secondary transfer roller 8 is configured to be movable between a contact position in contact with the intermediate transfer belt 7 and a separated position separated from the intermediate transfer belt 7. In particular, the secondary transfer roller 8 is disposed at the contact position when the full color toner image, which has been primarily transferred to a surface of the intermediate transfer belt 7, is secondarily transferred to the sheet of paper T, and otherwise is disposed at the separated position.

The opposing roller 18 is disposed opposite to the secondary transfer roller 8 across the intermediate transfer belt 7. A predetermined part of the intermediate transfer belt 7 is nipped between the secondary transfer roller 8 and the opposing roller 18. The sheet of paper T is pressed against an outer surface (a surface to which the toner image is primarily transferred) of the intermediate transfer belt 7. A secondary transfer nip N2 is formed between the intermediate transfer belt 7 and the secondary transfer roller 8. At the secondary transfer nip N2, the full-color toner image primarily transferred to the intermediate transfer belt 7 is secondarily transferred to the sheet of paper T.

The fixing unit 9 fuses and pressurizes toners of respective colors in order to fix the toners on the sheet of paper T. The toners of respective colors make up the toner image that is secondarily transferred onto the sheet of paper T. The fixing unit 9 includes a heating rotator 9*a* heated by a heater, and a pressurizing rotator 9*b* that is brought into pressure-contact with the heating rotator 9*a*. The heating rotator 9*a* and the pressurizing rotator 9*b* nip and compress the sheet of paper T to which the toner image is secondarily transferred, and then convey the sheet of paper T. The sheet of paper T is conveyed while nipped between the heating rotator 9*a* and the pressurizing rotator 9*b*. In this manner, the toner transferred to the sheet of paper T is fused and pressurized and thereby fixed to the sheet of paper T.

Next, the paper feeding/discharging portion KH will be described.

As shown in FIG. 1, two paper feeding cassettes 52 as units for housing sheets of paper T are disposed one above the other in a lower part of the main cabinet M. The paper feeding cassettes 52 are mounted on the case member BD, which is a housing of the main cabinet M, so as to be insertable and drawable in a forward horizontal direction. In other words, the paper feeding cassettes 52 house the sheets of paper T and are mounted on the case member BD so as to be insertable and drawable.

Each of the paper feeding cassettes 52 includes a paper tray 60 on which the sheets of paper T are placed. Each of the paper feeding cassettes 52 stores the sheets of paper T stacked on the paper tray 60. The sheets of paper T placed on paper trays 60 are fed out to the paper path L by cassette feeding portions 51. Each of the cassette feeding portions 51 is disposed on an end portion of each of the paper feeding cassettes 52 on a side for feeding paper (in a right end portion of FIG. 1).

Each of the cassette feeding portions 51 includes a double feed preventing mechanism composed of a forward feed roller 61 and a pair of feeding rollers 63. The forward feed roller 61 is for picking up a sheet of paper T on the paper tray 60. The pair of feeding rollers 63 is for feeding the sheets of paper T one sheet at a time to the paper path L.

The manual feeding portion 64 is provided on a right side face (right in FIG. 1) of the main cabinet M. The manual feeding portion 64 is provided primarily for feeding sheets of paper T that are different in size or type from sheets of paper T stored in the paper feeding cassettes 52 to the main cabinet M. The manual feeding portion 64 includes a manual feeding tray 65 and a paper feeding roller 66. The manual feeding tray 65 while being closed makes up a portion of a right side face of the main cabinet M. A lower end of the manual feeding tray 65 is rotatably attached (freely openable and closable) to the main cabinet M in the vicinity of the paper feeding roller 66. A sheet or sheets of paper T are placed on the manual feeding tray 65 while being opened. The paper feeding roller 66 feeds a sheet of paper T placed on the manual feeding tray 65 while being opened to the manual feeding path La.

The first discharging portion 50*a* and the second discharging portion 50*b* are provided at a position on an upper side in the main cabinet M and below the image reading unit 301. The first discharging portion 50*a* and the second discharging portion 50*b* discharge a sheet of paper T on which an image has been formed by the image forming unit GK to the outside of the main cabinet M. The first discharging portion 50*a* and the second discharging portion 50*b* will be described later in detail.

The paper path L includes the first paper path L1, second paper path L2, third paper path L3, manual paper path La, reverse paper path Lb and fourth paper path L4. The first paper path L1 is a feed path from the cassette feeding portions 51 to the secondary transfer nip N2. The second paper path L2 is a feed path from the secondary transfer nip N2 to the fixing unit 9. The third paper path L3 is a feed path from the fixing unit 9 to the first discharging portion 50*a*. The manual paper path La is a feed path that guides a sheet of paper T supplied from the manual feeding portion 64 to the first paper path L1. The reverse paper path Lb is a feed path that turns over the front and back sides of a sheet of paper T that is conveyed from upstream to downstream in the third paper path L3 and returns the sheet of paper T to the first paper path L1.

The third paper path L3 is a feed path that conveys a sheet of paper T from the image forming unit GK to the first discharging portion 50*a* (described below). The reverse paper path Lb branches from the third path L3. The fourth paper path L4 is a feed path for conveying a sheet of paper T, which is being conveyed in the third paper path L3, to the second discharging portion 50*b*.

In addition, a first junction P1 and a second junction P2 are provided midway in the first paper path L1. A first branch portion Q1 is provided midway in the third paper path L3.

The first junction P1 is where the manual paper path La merges with the first paper path L1. The second junction P2 is where the reverse paper path Lb merges with the first paper path L1.

The first branch portion Q1 is where the fourth paper path L4 branches off from the third paper path L3. A branching member 58 is provided at the first branch portion Q1. The branching member 58 switches a feeding direction of a sheet of paper T discharged from the fixing unit 9 to the third paper path L3 leading to the first discharging portion 50*a* or to the fourth paper path L4 leading to the second discharging portion 50*b*.

In addition, a sensor and the pair of registration rollers 80 are disposed midway in the first paper path L1 (more specifically, between the second junction P2 and the secondary transfer roller 8). The sensor detects a sheet of paper T. The sensor is disposed immediately in front of the pair of registration rollers 80 in a direction of conveying the sheet of paper T (upstream of the conveying direction). The pair of registration rollers 80 adjusts the timing between feeding the sheet of paper T and forming a toner image in the image forming unit GK, and the correction of skew (paper inclination) of the sheet of paper T. The pair of registration rollers 80 conveys the sheet of paper T through correction and timing adjustment as described above based on the detection signal information from the sensor.

The reverse paper path Lb is a paper path where one surface (unprinted surface) opposite to another surface that has already been printed is set to face the intermediate transfer belt 7, when duplex printing of a sheet of paper T is performed. The reverse paper path Lb can turn over and return a sheet of paper T, which has been conveyed from the first branch portion Q1 toward the first discharging portion 50*a* or the second discharging portion 50*b*, to the first paper path L1, in order to convey the sheet of paper T to upstream of the pair of registration rollers 80 disposed upstream of the secondary transfer roller 8. When a sheet of paper T is conveyed from the first branch portion Q1 to the first discharging portion 50*a*, the reverse paper path Lb conveys the sheet of paper T, which has been turned over by a pair of discharging and reversing rollers 55 (described below) provided at the first discharging portion 50*a*, to the image forming unit GK. In the secondary transfer nip N2, a predetermined toner image is transferred to the unprinted surface of the sheet of paper T that has been turned over by the reverse paper path Lb.

The first discharging portion 50*a* is formed at an end portion of the third paper path L3 as a discharging portion. The first discharging portion 50*a* discharges a sheet of paper T, which does not require post-processing, to outside the main cabinet M. As shown in FIG. 1, the first discharging portion 50*a* is disposed at a position on an upper side in the main cabinet M and below the image reading unit 301. In addition, the first discharging portion 50*a* has an opening toward a left side face of the main cabinet M (left side in FIG. 1) and is disposed towards a right side face of the main cabinet M. A stacking space portion 540 described below is formed on an opened side of the first discharging portion 50*a*.

The pair of discharging and reversing rollers 55 is provided at the first discharging portion 50*a*. The pair of discharging and reversing rollers 55 has the function of completely discharging a sheet of paper T conveyed in the third paper path L3 from the first discharging portion 50*a* to the stacking space portion 540 (described below). In addition, the pair of discharging and reversing rollers 55 has the function of a reversing portion (for switchback) that partially feeds out a sheet of paper T from the first discharging portion 50*a* to the stacking space portion 540 (described below) and turns over the sheet of paper T, which has been conveyed in the third paper path L3. In this manner, the pair of discharging and reversing rollers 55 has not only the function of completely discharging the sheet of paper T to the stacking space portion 540 (described below) but also the function of a reversing unit. When the pair of discharging and reversing rollers 55 exhibits the function of a reversing unit, the pair of discharging and reversing rollers 55 is termed a "switchback roller pair."

As illustrated in FIG. 1, the inner accumulating portion 510 as a stacking unit is disposed below the image reading unit 301. Sheets of paper T discharged from the first ejection unit 50*a* are stacked in the inner accumulating portion 510. A pressing member 200 is disposed in the stacking space portion 540 (described below) of the inner accumulating portion 510. The pressing member 200 is disposed in contact with an upper surface of a sheet of paper T stacked on the stacking surface portion 520.

The details of the inner accumulating portion 510 and the pressing member 200 will be described below.

The second discharging portion 50*b* is formed on an end (downstream in the feed direction) of the fourth paper path L4. The second discharging portion 50*b* is formed to open towards the left side face of the main cabinet M below the first discharging portion 50*a* (left side of FIG. 1). The second discharging portion 50*b* is a discharging portion for post-processing (or a discharging portion for a relay unit 500) that feeds out a sheet of paper T, which has been conveyed to the fourth paper path L4, to a post-processing device 600 via the relay unit 500 (described below).

Sensors for paper detection are disposed at predetermined positions in the respective paper paths.

The relay unit 500 is disposed continuously with the main cabinet M (connected to the main cabinet M) on an open side of the second discharging portion 50*b*. The relay unit 500 is attached to the main cabinet M in contact with the stacking space portion 540 below the image reading unit 301. An upper surface of the relay unit 500 is configured as the stacking surface portion 520 for stacking sheets of paper T discharged from the first discharging portion 50*a*. The post-processing device 600 is disposed continuously with the relay unit 500 (connected to the main cabinet M).

The post-processing device 600 executes post-processing on the sheets of paper T (stapling, punching, sorting, and the like). The sheets of paper T are subjected to post-processing, which have been discharged from the second discharging portion 50*b* of the main cabinet M, and conveyed to the post-processing device 600 via an inner paper path 551 of the relay unit 500. The post-processing device 600 is detachably mounted on a left surface 441 of the main cabinet M. The post-processing device 600 includes a discharged paper tray 660. The discharged paper tray 660 accumulates sheets of paper T discharged from a discharging portion (not illustrated) of the post-processing device 600.

When post-processing is not required, the copying machine 1 in the present embodiment may set the paper ejection destination (paper path route) for a sheet of paper T after completion of image formation in the image forming unit GK to the following two options.

A first option is a setting in which although a sheet of paper T is sent to the post-processing device 600 from the fourth paper path L4 through the relay unit 500, the post-processing device 600 is set to discharge the sheet of paper T to the discharged paper tray 660 without executing post-processing.

A second option is a setting in which the copying machine 1 discharges a sheet of paper T from the first discharging portion 50*a* at the end of the third paper path L3 to the inner accumulation unit 510 without sending the sheet of paper T to the fourth paper path L4. The sheet of paper T discharged from the first discharging portion 50*a* to the inner accumulation unit 510 is accumulated on the stacking surface portion 520 that is the upper surface of the relay unit 500. The sheet of paper T accumulated on the stacking surface portion 520 is removed on a front side of the main cabinet M.

A structure will be briefly described below for eliminating a paper jam (JAM) in main paper paths L1 to L3 (the first paper path L1, the second paper path L2, and the third paper path L3 are also collectively referred to as "main paper paths" hereinafter), and in the reverse paper path Lb.

As shown in FIG. 1, the main paper paths L1 to L3 and the reverse paper path Lb are disposed to extend in parallel in a substantially perpendicular direction on a right lateral face side of the main cabinet M (right side in FIG. 1). A cover assembly 40 is provided on a right side face of the main cabinet M (right side in FIG. 1) to constitute a part of the side face of the main cabinet M. A lower end portion of the cover assembly 40 is connected with the main cabinet M via a fulcrum shaft 43. An axial direction of the fulcrum shaft 43 is disposed along a direction intersecting the main paper paths L1 to L3 and the reverse paper path Lb. The cover assembly 40 is pivotally configured about the fulcrum shaft 43 between a closed position (illustrated in FIG. 1) and an opened position (not illustrated).

The cover assembly 40 is composed of a first cover 41 and a second cover 42. The first cover 41 is pivotally connected with the main cabinet M by the fulcrum shaft 43. The second cover 42 is pivotally connected with the main cabinet M by the fulcrum shaft 43 in a similar manner to the first cover 41. The first cover 41 is positioned more outward (to a lateral face side) than the second cover 42 in the main cabinet M. It should be noted that the first cover 41 is illustrated as the part hatched with falling diagonal broken lines in FIG. 1 from top left to bottom right. The second cover 42 is illustrated as the part hatched with falling diagonal broken lines from top right to bottom left.

In a state where the cover assembly 40 is in a closed position, an outer face of the first cover 41 constitutes a portion of an outer face (side face) of the main cabinet M.

In addition, in a state in which the cover assembly 40 is in the closed position, an inner face (facing inside the main cabinet M) of the second cover 42 constitutes a portion of the main paper paths L1 to L3.

Furthermore, in a state where the cover assembly 40 is in the closed position, an inner face of the first cover 41 and an outer face of the second cover 42 constitute at least a portion of the reverse paper path Lb. In other words, the reverse paper path Lb is formed between the first cover 41 and the second cover 42.

Since the copy machine 1 according to the present embodiment is provided with the cover assembly 40 having the above configuration, a sheet of jammed paper in the main paper paths L1 to L3 can be removed by pivoting the cover assembly 40 from the closed position shown in FIG. 1 to an opened position (not shown) so as to allow the main paper paths L1 to L3 to be exposed, when a paper jam (JAM) occurs in the main paper paths L1 to L3. On the other hand, when a paper jam occurs in the reverse paper path Lb, a sheet of jammed paper in the reverse paper path Lb can be removed by pivoting the cover assembly 40 to the opened position and then pivoting the second cover 42 about the fulcrum shaft 43 toward the main cabinet M (left side in FIG. 1) so as to allow the reverse paper path Lb to be exposed.

Figure 2:
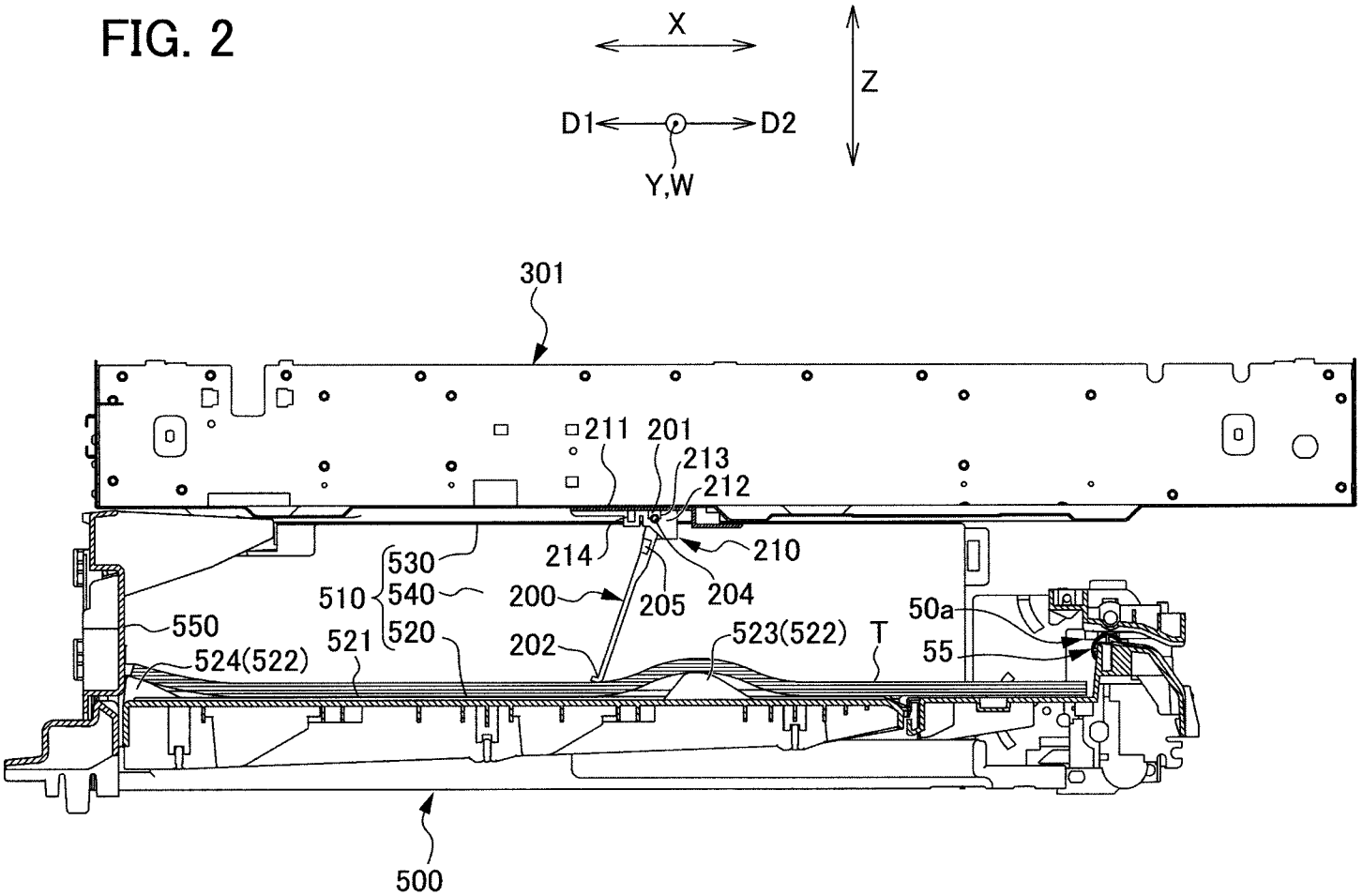
FIG. 2 is a side view illustrating the configuration of a pressing member 200 and an inner accumulating portion 510 according to the first embodiment.
Figure 3:
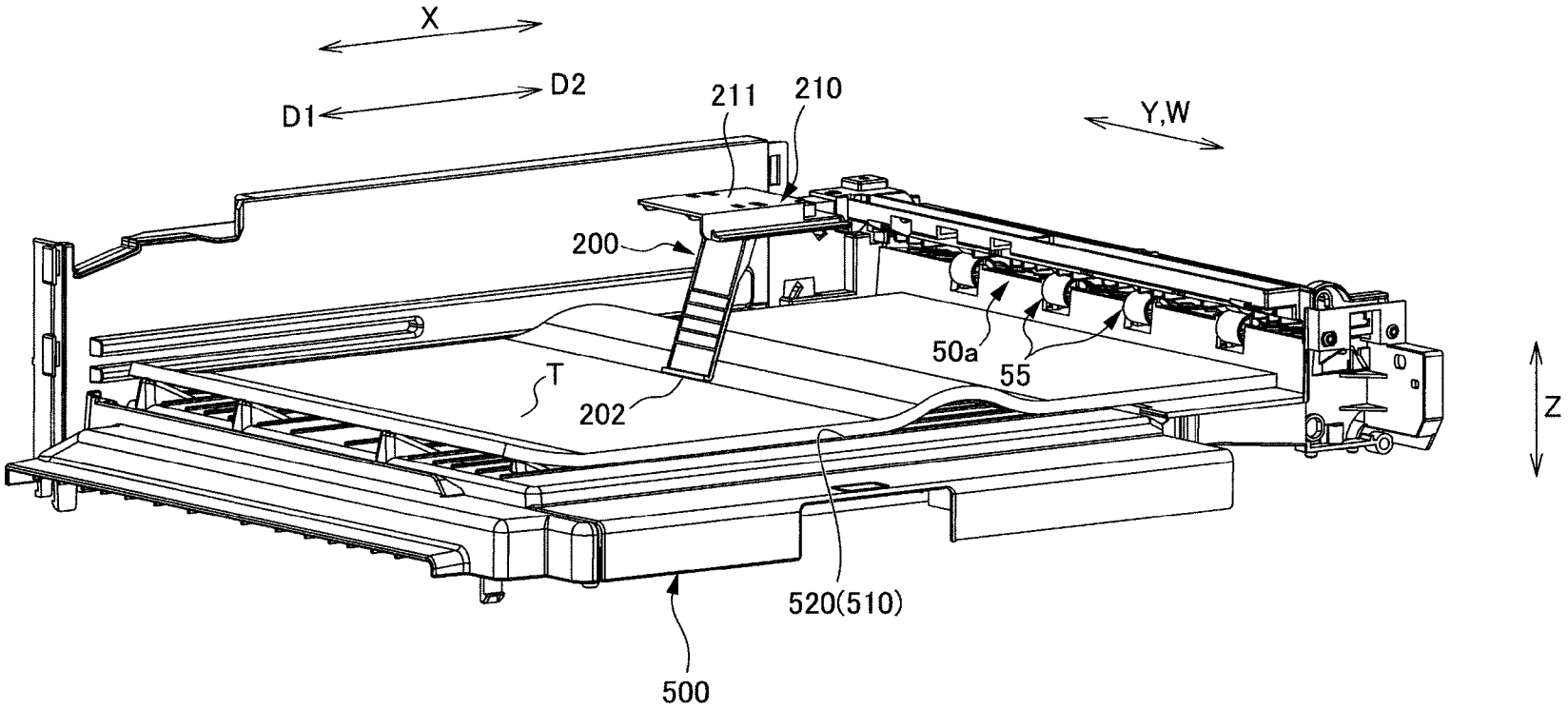
FIG. 3 is a perspective view illustrating the configuration of the pressing member 200 and a stacking surface portion 520 according to the first embodiment.
Figure 4:
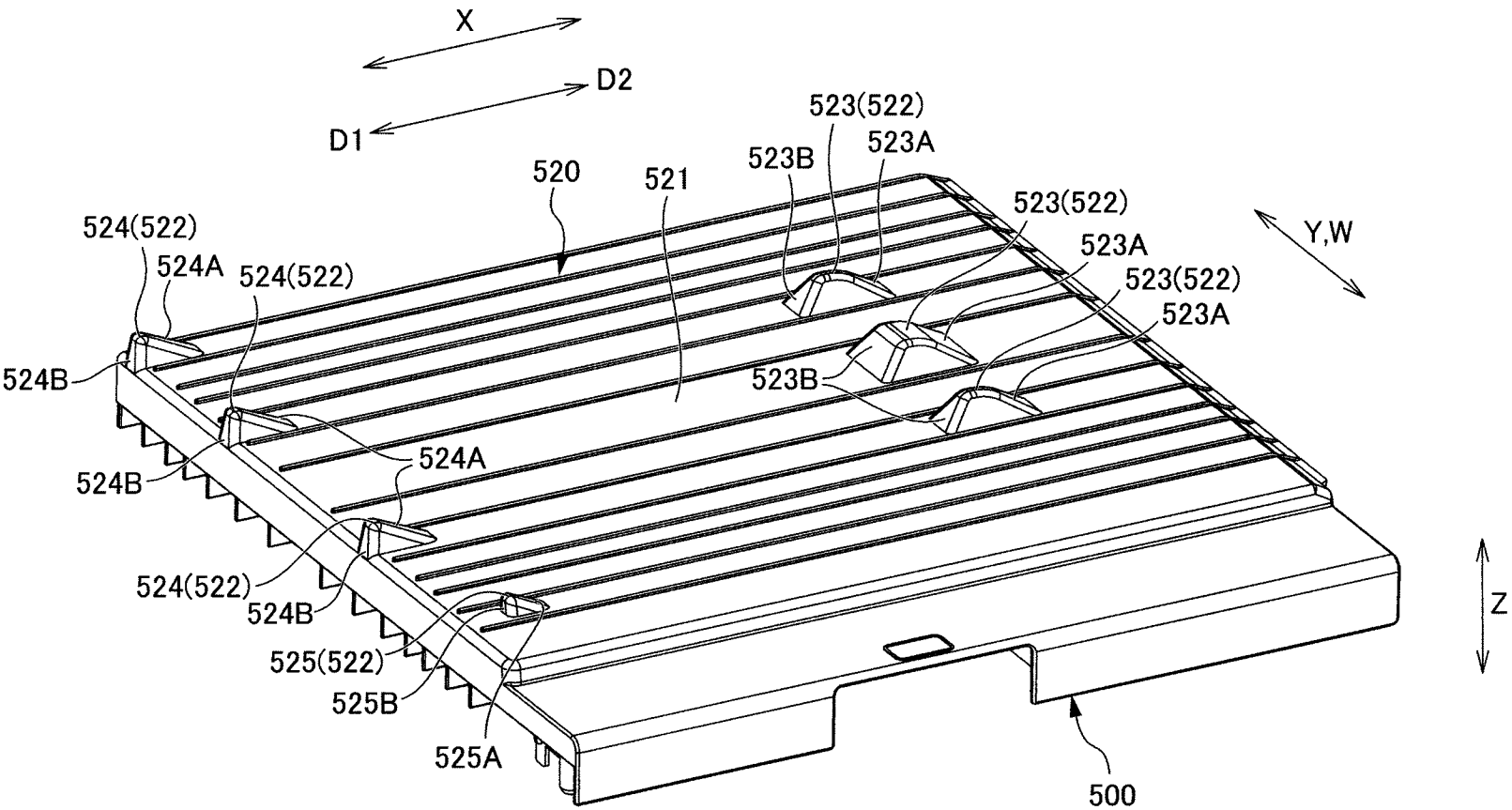
FIG. 4 is a perspective view illustrating the configuration of the stacking surface portion 520 according to the first embodiment.
Figure 5:
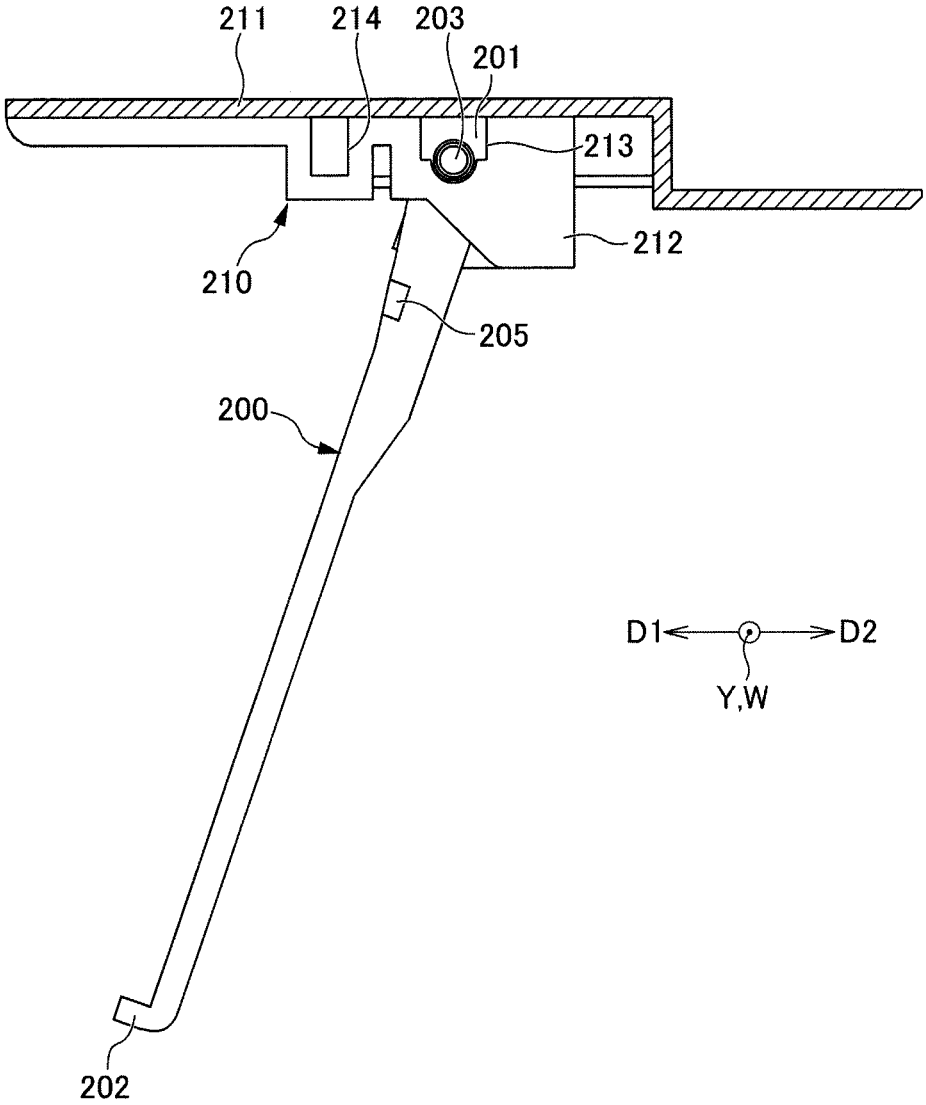
FIG. 5 is a side view illustrating an enlargement of the pressing member 200 in FIG. 2.

Next, the configuration related to the inner accumulation portion 510 and the pressing member 200 that are characteristic portions of the present disclosure will be described in detail with reference to FIGS. 2 to 5. FIG. 2 is a side view illustrating the configuration of the pressing member 200 and the inner accumulating portion 510 according to the first embodiment. FIG. 3 is a perspective view illustrating the configuration of the pressing member 200 and the stacking surface portion 520 according to the first embodiment. FIG. 4 is a perspective view illustrating the configuration of the stacking surface portion 520 according to the first embodiment. FIG. 5 is a side view illustrating an enlargement of the pressing member 200 in FIG. 2.

In the present embodiment, a direction in which a sheet of paper T conveyed by the pair of discharging and reversing rollers 55 is discharged from the first discharging portion 50*a* towards the inner accumulation portion 510 is termed a "discharging direction D1." The "discharging direction D1" substantially corresponds to a direction from the first discharging portion 50*a* towards the inner accumulation portion 510 in the secondary scanning direction X. Furthermore, a direction opposite to the discharging direction D1 is termed a "return direction D2," in which a sheet of paper T partially fed out to the stacking space portion 540 is returned from the inner accumulation portion 510 to the discharging portion 50*a* by the pair of discharging and reversing rollers 55. The "return direction D2" substantially corresponds to a direction from the inner accumulation portion 510 towards the first discharging portion 50*a* in the secondary scanning direction X. A direction orthogonal to the discharging direction D1 and the return direction D2 is termed a "paper width direction W," which is oriented along a sheet of paper T that is stacked on the stacking surface portion 520. The "paper width direction W" substantially corresponds to the main scanning direction Y.

As illustrated in FIGS. 2 and 3, the inner accumulation portion 510 includes a stacking surface portion 520, a stacking top surface portion 530 as an upper surface portion, a stacking space portion 540, and a restriction wall 550 as a restriction portion.

The stacking surface portion 520 is disposed at a lower portion in the vertical direction Z in the inner accumulation portion 510. A sheet of paper T on which a predetermined toner image has been formed and that has been discharged from the first discharging portion 50*a* is stacked on the stacking surface portion 520. An upper surface of the relay unit 500 is utilized for the stacking surface portion 520.

As illustrated in FIGS. 2 and 4, the stacking surface portion 520 is configured to include a planar portion 521 and a plurality of protruding portions 522.

The planar portion 521 is formed as a horizontal surface. The plurality of protruding portions 522 is formed to project upward from the planar portion 521 in the vertical direction Z. Each protruding portion 522 is formed in a shape of a ridge having a top when viewed in the paper width direction W.

The plurality of protruding portions 522 is composed of three first protruding portions 523, three second protruding portions 524 and one third protruding portion 525. The three first protruding portions 523 and the three second protruding portions 524 have substantially the same height. Furthermore, the one third protruding portion 525 has a height that is lower than the three first protruding portions 523 and the three second protruding portions 524.

The three first protruding portions 523 have substantially the same shape when viewed in the paper width direction W. The three first protruding portions 523 are arranged spaced in series in the paper width direction W and more upstream than the center of the stacking surface portion 520 in the discharging direction D1. The three first protruding portions 523 include one first protruding portion 523 that is formed at the center of the stacking surface portion 520 in the paper width direction W and two first protruding portions 523 that are arranged spaced on both sides of the one first protruding portion 523.

Each of the three first protruding portions 523 includes a first upward slope 523A and a first downward slope 523B. The first upward slope 523A is formed upstream in the discharging direction D1. The first downward slope 523B is formed downstream in the discharging direction D1.

The first upward slope 523A inclines upwardly from upstream to downstream in the discharging direction D1. An angle of the first upward slope 523A to the planar portion 521 is determined so that a sheet of paper T discharged in the discharging direction D1 is conveyed without interference.

The first downward slope 523B is formed continuously with the first upward slope 523A through a smooth curved surface in proximity to the top of the first protruding portion 523. The first downward slope 523B inclines downwardly from upstream to downstream in the discharging direction D1. An angle of the first downward slope 523B to the planar portion 521 is determined greater than the inclination angle of the first upward slope 523A.

The three second protruding portions 524 have substantially the same shape when viewed in the paper width direction W. The three second protruding portion 524 are disposed in series in the paper width direction W and in proximity to an end portion of the stacking surface portion 520 downstream in the discharging direction D1. The three second protruding portions 524 includes one second protruding portion 524 that is formed adjacent to one end of the stacking surface portion 520 in the paper width direction W and two other second protruding portions 524 spaced in series at respective predetermined distances from the one second protruding portion 524 in the paper width direction W.

Each of the respective three second protruding portions 524 includes a second upward slope 524A and a second downward slope 524B. The second upward slope 524A is formed upstream in the discharging direction D1. The second downward slope 524B is formed downstream in the discharging direction D1.

The second upward slope 524A inclines upwardly from the upstream to downstream in the discharging direction D1. An angle of the second upward slope 524A to the planar portion 521 is determined so that a sheet of paper T discharged in the discharging direction D1 is conveyed without interference.

The second downward slope 524B is connected with the second upward slope 524A in proximity to the top of the second protruding portion 524. The second downward slope 524B inclines downwardly from upstream to downstream. An angle of the second downward slope 524B to the planar portion 521 is determined greater than the inclination angle of the second upward slope 524A. The second downward slope 524B is disposed in proximity to the restriction wall 550, and faces the restriction wall 550.

The one third protruding portion 525 is disposed more upstream than a downstream end of the stacking surface portion 520 in the discharging direction D1. The one third protruding portion 525 is disposed in proximity to another end of the stacking surface portion 520 in the paper width direction W. The third protruding portion 525 includes a third upward slope 525A and a third downward slope 525B. The third upward slope 525A is formed upstream in the discharging direction D1. The third downward slope 525B is formed downstream in the discharging direction D1.

The restriction wall 550 restricts sheets of paper T stacked on the stacking surface portion 520 from moving in the discharging direction D1. As illustrated in FIG. 2, the restriction wall 550 is formed to extend upwardly in the vertical direction Z from the vicinity of an outer edge of the stacking surface portion 520 (the left side of the main cabinet M in FIG. 1), downstream in the discharging direction D1. The restriction wall 550 faces the distal end of a sheet of paper T stacked on the stacking surface portion 520 in the discharging direction D1. In this manner, the restriction wall 550 controls the position of the distal end of a sheet of paper T discharged from the first discharging portion 50*a*, thereby restricting the sheet of paper T from moving towards downstream in the discharging direction D1.

The stacking surface portion 520 includes a surface area that enables stacking of a sheet of paper T of maximum size.

A virtual surface is assumed for the stacking surface portion 520. The virtual surface is a flat surface under the assumption that there is not the plurality of protruding portions 522 (the first protruding portion 523, the second protruding portion 524, and the third protruding portion 525). With respect to the stacking surface portion 520 according to the present embodiment, the length from an end of the virtual surface on a side closer to the first discharging portion 50*a* to the restriction wall 550 is less than the length of the sheet of paper T of maximum size in the discharging direction D1. Consequently, when the sheet of paper T of maximum size is stacked on the stacking surface portion 520 in parallel with the virtual surface, the sheet of paper T of maximum size cannot be stacked on the stacking surface portion 520.

The length along a surface from the end of the stacking surface portion 520 including the plurality of protruding portions 522 on the side closer to the first discharging portion 50*a* to the restriction wall 550 is equal to or greater than the length of the sheet of paper T of maximum size in the discharging direction D1. In this configuration, the stacking surface portion 520 enables stacking of the sheet of paper T of maximum size having a greater length in the discharging direction D1 than the virtual surface (the surface without the plurality of protruding portions 522 on the stacking surface portion 520).

For example, when the sheet of paper T of maximum size is a size A3, the length of the surface of the stacking surface portion 520 including the plurality of protruding portions 522 in the discharging direction D1 is set to be equal to or greater than the length of the longer side of a sheet of A3 size paper. The length of the surface of the stacking surface portion 520 in the paper width direction W is set to be equal to or greater than the length of the shorter side of the sheet of A3 size paper. In the present embodiment, when a sheet of A3 size paper T is discharged while the longer side of the sheet of A3 size paper is in parallel with the discharging direction D1, the sheet of A3 size paper T is termed a "sheet of A3 vertical paper T."

The stacking top surface portion 530 is spaced a predetermined distance upward from and disposed opposite to the stacking surface portion 520 in the vertical direction Z. A surface of the lower portion of the image reading unit 301 is utilized for the stacking top surface portion 530, which is configured to be flat.

The stacking space portion 540 is between the stacking surface portion 520 and the stacking top surface portion 530. A sheet of paper T discharged from the first discharging portion 50*a* is guided into the stacking space portion 540. The stacking space portion 540 is where sheets of paper T stacked on the stacking surface portion 520 are housed.

Furthermore, the stacking space portion 540 has a front aperture that opens onto outside the front surface of the main cabinet M. The sheets of paper T stacked on the stacking surface portion 520 can be removed through the front aperture of the main cabinet M. That is to say, the stacking space portion 540 of the copying machine 1 in the present embodiment is formed as a recessed portion of the main cabinet M under the image reading unit 301. Consequently, the copying machine 1 according to the present embodiment is termed a so-called copying machine of paper discharged inside a cabinet.

As illustrated in FIG. 2, a pressing member 200 is disposed in the stacking space portion 540.

The pressing member 200 includes a plate portion. When viewed in the paper width direction W, the plate portion of the pressing member 200 is formed flat to extend from the stacking top surface portion 530 towards the stacking surface portion 520.

A base portion 201 of the pressing member 200 (one end of the pressing member 200) is attached rotatably to the stacking top surface portion 530 (the lower surface of the image reading unit 301) through a mounting member 210.

A distal end portion 202 of the pressing member 200 (another end of the pressing member 200) is configured as a free end. The distal end portion 202 of the pressing member 200 is disposed in contact with the upper surface of the uppermost sheet of sheets of paper T stacked in the stacking surface portion 520. The pressing member 200 comes in contact with the uppermost sheet of paper T due to its self weight at the distal end portion 202 and applies weight to the sheets of paper T.

"The upper surface of the uppermost sheet of the sheets of paper T stacked in the stacking surface portion 520" in the following description is also referred to as "an uppermost surface of the sheets of paper T stacked in the stacking surface portion 520."

A flat plane connecting the base portion 201 and the distal end portion 202 of the pressing member 200 is inclined so that the distal end portion 202 is positioned more distant from the first discharging portion 50*a* (downstream in the discharging direction D1) than the base portion 201 relative to the upper surface of the sheet of paper T stacked on the stacking surface portion 520.

As illustrated in FIGS. 2 and 3, the pressing member 200 is disposed in contact with the upper surface of the sheet of paper T stacked on the stacking surface portion 520 in proximity to the center of the discharging direction D1.

Furthermore, the pressing member 200 is disposed in contact with the upper surface of the sheet of paper T stacked on the stacking surface portion 520, in proximity to the first protruding portion 523 and more downstream than the first protruding portion 523 in the discharging direction D1. The pressing member 200 is disposed in contact with the upper surface of the sheet of paper T stacked on the stacking surface portion 520, while deforming the sheet of paper T along the first protruding portion 523, compared with a state in which the pressing member 200 is not contact with the upper surface of the sheet of paper T stacked on the stacking surface portion 520. It may not be necessary for the pressing member 200 to deform the sheet of paper T stacked on the stacking surface portion 520 to be completely deformed along the first protruding portion 523. The pressing member 200 may deform the sheet of paper T along the first protruding portion 523.

As illustrated in FIG. 3, the pressing member 200 is disposed in contact with the upper surface of the sheet of paper T stacked on the stacking surface portion 520 in proximity to the center of the paper width direction W.

The pressing member 200 is formed substantially rectangular when viewed along the thickness direction. The distal end portion 202 of the pressing member 200 is curved opposite to the first discharging portion 50*a*. In the pressing member 200, a portion of the distal portion 202 that is in contact with a sheet of paper T is configured as a flat surface that has a predetermined length in the paper width direction W.

The pressing member 200 described above allows a sheet of paper T to move to be stacked on the stacking surface portion 520 by rotating so that the distal end portion 202 moves in a direction opposite to the first discharging portion 50*a*. The pressing member 200 comes in contact with the upper surface of the sheet of paper T that is allowed to move in the direction opposite to the first discharging portion 50*a*, and deforms this sheet of paper T along the first protruding portion 523.

The above operation may be realized by suitably setting the angle of the pressing member 200 relative to the sheet of paper T stacked on the stacking surface portion 520 and the weight applied to this sheet of paper T.

As illustrated in FIG. 5, the pressing member 200 further includes a rotation shaft 203 and a mounting projecting portion 205.

The rotation shaft 203 is inserted into a rotation supporting hole 213 of the mounting member 210 (described below). The rotation shaft 203 is formed to project on both outer sides in the paper width direction W at the base portion 201 of the pressing member 200. The central axis of the rotation shaft 203 extends in the paper width direction W.

The mounting projecting portion 205 is configured to engage with a retraction hole 214 of the mounting member 210 (described below). The mounting projecting portion 205 is formed in proximity to the base portion 201 between the base portion 201 and the distal end portion 202 of the pressing member 200. The mounting projecting portion 205 is formed to project outward from the side surface of the pressing member 200 in the paper width direction W.

The mounting member 210 rotatably supports the pressing member 200. As illustrated in FIG. 2, the mounting member 210 is attached to the stacking top surface portion 530.

As illustrated in FIG. 5, the mounting member 210 includes a mounting plate portion 211 and a pair of side plate portions 212. The pair of side plate portions 212 extends from proximity to both end portions of the mounting plate portion 211 in the paper width direction W towards a lower side in the vertical direction Z. The mounting plate portion 211 is a plate portion that is parallel to the stacking top surface portion 530. The mounting plate portion 211 is attached to the stacking top surface portion 530. The pair of side plate portions 212 is made of plate portions that are parallel to the discharging direction D1 and the paper width direction W. The pair of side plate portions 212 is disposed opposite to each other.

A pair of rotation supporting holes 213 and a pair of retraction holes 214 penetrating in the paper width direction W are formed respectively in the pair of side plate portions 212 of the mounting member 210.

The rotation shaft 203 of the pressing member 200 is inserted into the rotation supporting hole 213. The rotation supporting hole 213 accommodates the rotation shaft 203. The rotation supporting hole 213 rotatably supports the pressing member 200. Since the rotation shaft 203 of the pressing member 200 is disposed by insertion into the rotation supporting hole 213, the pressing member 200 comes in contact with the upper surface of the sheet of paper T stacked on the stacking surface portion 520 due to the self weight of the pressing member 200.

The mounting projecting portion 205 of the pressing member 200 can engage with the retraction hole 214. The retraction hole 214 is formed at a position at which the mounting projecting portion 205 is engaged, in a state in which the pressing member 200 is disposed along the stacking top surface portion 530. The retraction hole 214 engages with the mounting projecting portion 205 of the pressing member 200, when the pressing member 200 rotates about the rotation axis of the rotation shaft 203 to be disposed along the lower surface (stacking top surface 530) of the image reading unit 301.

Next, the operation of the copying machine 1 according to the present embodiment will be briefly described making reference to FIG. 1.

The operation of the copying machine 1 will be described for a case where the copying machine is set so that a sheet of paper T is discharged into the inner accumulation portion 510.

In the present embodiment, the operation of the copying machine 1 will be described for a case where printing is performed for a sheet of paper T of A3 vertical-length making reference to FIGS. 6A to 6G while describing the operation of the pressing member 200.

Figure 6A:
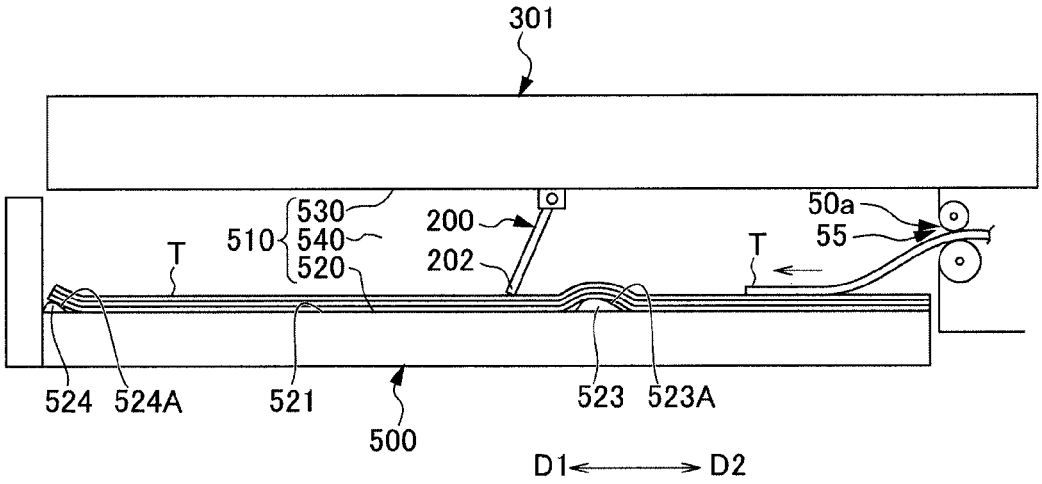
FIG. 6A illustrates an operation of simplex printing in which a sheet of paper T starts to be conveyed in a discharging direction D1.
Figure 6B:
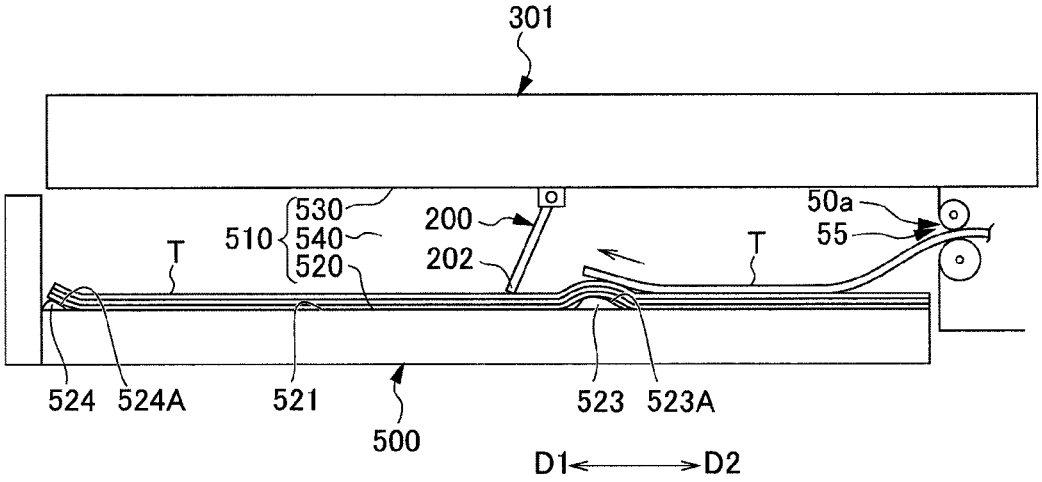
FIG. 6B illustrates an operation of simplex printing in which a sheet of paper T is conveyed along a first protruding portion 523.
Figure 6C:
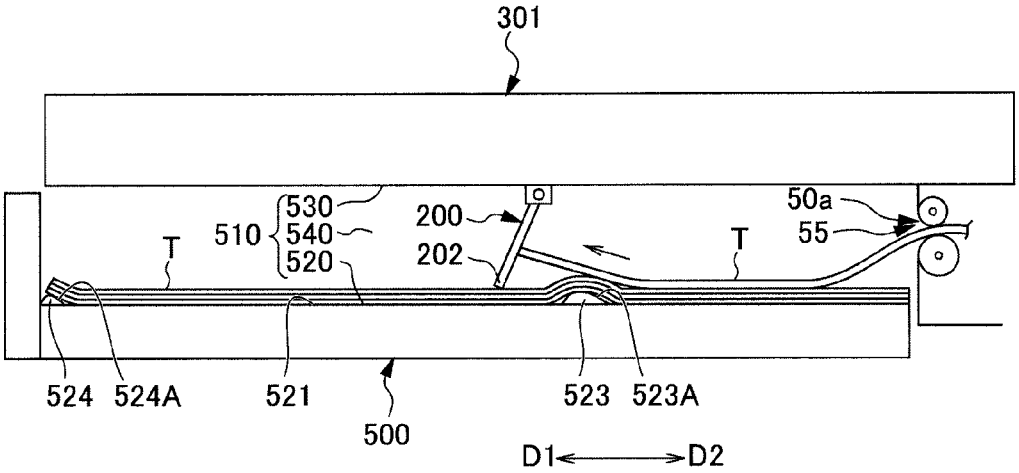
FIG. 6C illustrates an operation of simplex printing in which a sheet of paper T abuts with a pressing member 200 in a stiff configuration.
Figure 6D:
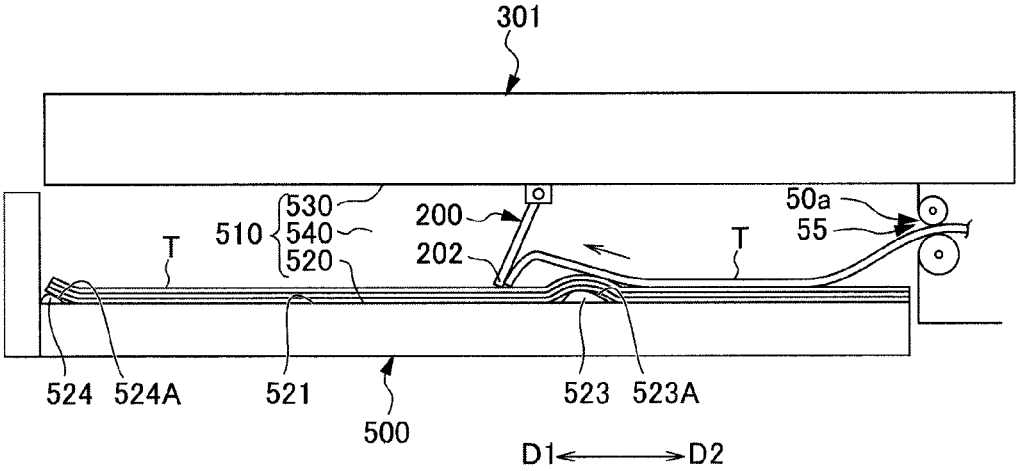
FIG. 6D illustrates an operation of simplex printing in which the distal end of a sheet of paper T has moved towards a distal end portion 202 of the pressing member 200.
Figure 6E:
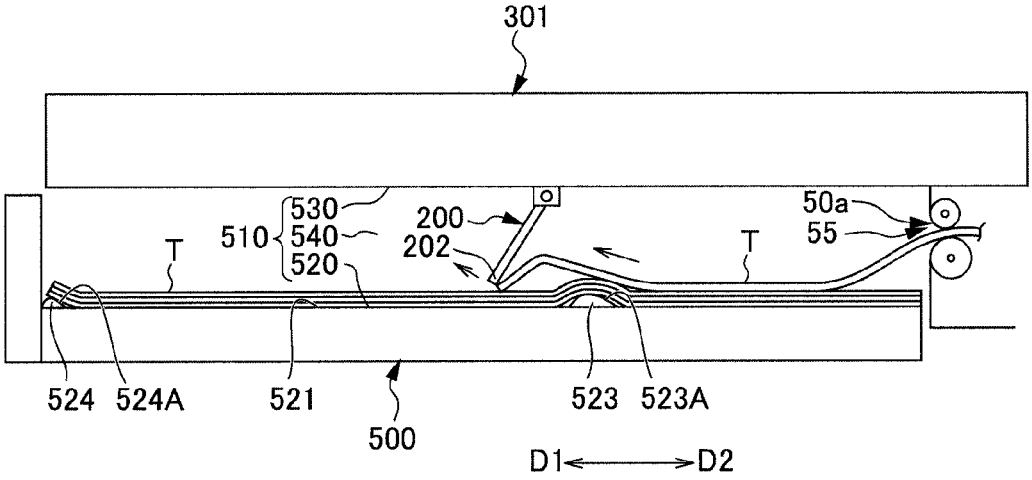
FIG. 6E illustrates an operation of simplex printing in which a sheet of paper T has caused the pressing member 200 to rotate.
Figure 6F:
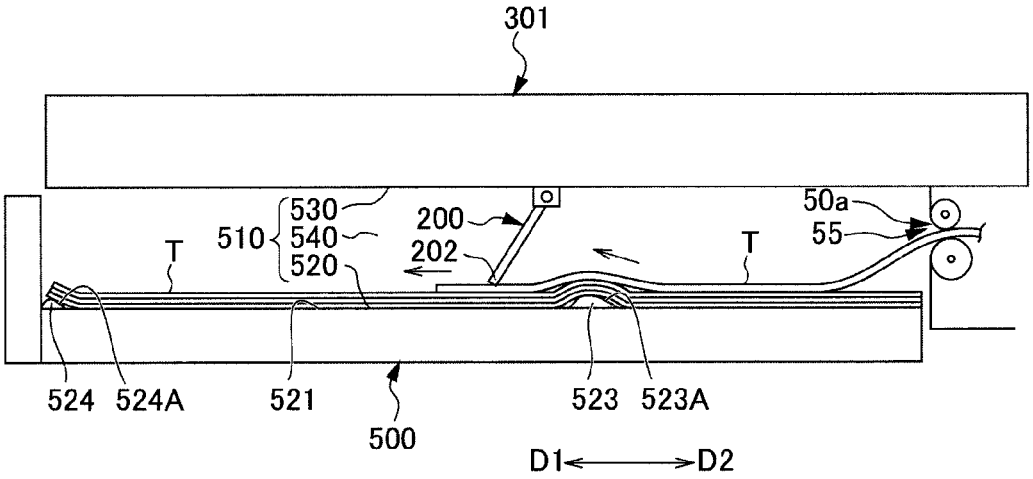
FIG. 6F illustrates an operation of simplex printing in which a sheet of paper T is being conveyed in the discharging direction D1 in contact with the distal end portion 202 of the pressing member 200.
Figure 6G:
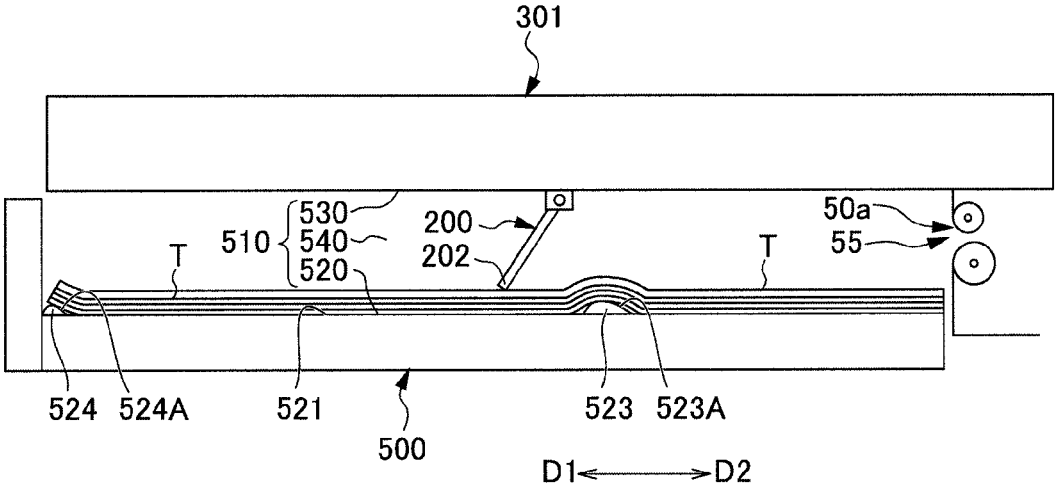
FIG. 6G illustrates an operation of simplex printing in which a sheet of paper T is stacked on the stacking surface portion 520 after completion of simplex printing.

FIG. 6A illustrates the operation of simplex printing and illustrates the configuration when a sheet of paper T starts to be conveyed in the discharging direction D1. FIG. 6B illustrates the operation of simplex printing in which a sheet of paper T is conveyed along the first protruding portion 523. FIG. 6C illustrates the operation of simplex printing in which a sheet of paper T is in contact with the pressing member 200 in a stiff configuration. FIG. 6D illustrates the operation of simplex printing in which the distal end of a sheet of paper T has moved towards the distal end portion 202 of the pressing member 200. FIG. 6E illustrates the operation of simplex printing in which a sheet of paper T has rotated the pressing member 200. FIG. 6F illustrates the operation of simplex printing in which a sheet of paper T has moved in the discharging direction D1 in contact with the distal end portion 202 of the pressing member 200. FIG. 6G illustrates the operation of simplex printing in which a sheet of paper T is stacked on the stacking surface portion 520 after completion of simplex printing.

Firstly, simplex printing of a sheet of paper T of A3 vertical-length stored in the sheet cassette 52 will be described.

The sheet of paper T of A3 vertical-length stored in the sheet cassette 52 is fed out to the first paper path L1 by the forward feed roller 61 and the pair of feeding rollers 63. Then, the sheet of paper T is conveyed to the pair of registration rollers 80 through the first junction P1 and the first paper path L1.

Skew correction of the sheet of paper T and timing adjustment in relation to a toner image are executed in the pair of registration rollers 80.

The sheet of paper T of A3 vertical-length discharged from the pair of registration rollers 80 is introduced between the intermediate transfer belt 7 and the secondary transfer roller 8 (secondary transfer nip N2) through the first paper path L1. A toner image is transferred onto the sheet of paper T between the intermediate transfer belt 7 and the secondary transfer roller 8.

Thereafter, the sheet of paper T of A3 vertical-length is discharged between the intermediate transfer belt 7 and the secondary transfer roller 8. The sheet of paper T discharged between the intermediate transfer belt 7 and the secondary transfer roller 8 is introduced to a fixing nip between the heating rotator 9*a* and the pressurizing rotator 9*b* in the fixing unit 9 through the second paper path L2. The toner is fused at the fixing nip and fixed onto the sheet of paper T.

Next, the sheet of paper of A3 vertical-length is conveyed to the first discharging portion 50*a* through the third paper path L3. The sheet of paper T conveyed to the first discharging portion 50*a* is discharged from the first discharging portion 50*a* to the stacking space portion 540 of the inner accumulation portion 510 by the pair of discharging and reversing rollers 55.

As illustrated in FIG. 6A, the lower surface of the sheet of paper T discharged from the first discharging portion 50*a* comes into contact with the uppermost surface of sheets of paper T stacked on the stacking surface portion 520. The sheet of paper T discharged from the first discharging portion 50*a* is conveyed in the discharging direction D1 in contact with the uppermost surface of the sheets of paper T stacked on the stacking surface portion 520.

Thereafter, the sheet of paper of A3 vertical-length fed out to the stacking space portion 540 is further conveyed in the discharging direction D1 by the pair of discharging and reversing rollers 55. As illustrated in FIG. 6B, the sheet of paper T of A3 vertical-length is conveyed diagonally upward along the first upward slope 523A of the first protruding portion 523.

As illustrated in FIG. 6C, the distal end of the sheet of paper T conveyed diagonally upward abuts in a stiff state with the pressing member 200 at a portion that is more upward than the distal end portion 202 on the surface facing the first discharging portion 50*a*.

As illustrated in FIG. 6D, since the sheet of paper T moves in the discharging direction D1, the distal end of the sheet of paper T abutting with the pressing member 200 moves from a position that is more upward than the distal end portion 202 of the pressing member 200 towards the distal end portion 202 along the surface facing the first discharging portion 50*a*. The distal end side of the conveyed sheet of paper T is curved to be upwardly convex.

The conveyed sheet of paper T is further conveyed by the pair of discharging and reversing rollers 55. As illustrated in FIG. 6E, the sheet of paper T presses the surface facing the first discharging portion 50*a* in the distal end portion 202 of the pressing member 200. In this manner, the sheet of paper T causes the pressing member 200 to rotate so that the distal end portion 202 of the pressing member 200 moves in the discharging direction D1 (downstream of the discharging direction D1).

Thereafter, the sheet of paper T further conveyed in the discharging direction D1 enters below the pressing member 200 and passes between the uppermost sheet of the sheets of paper T stacked on the stacking surface portion 520 and the pressing member 200. The sheet of paper T conveyed in the discharging direction D1 is conveyed as illustrated in FIG. 6F in the discharging direction D1 in a state in which the upper surface of the sheet of paper T is in contact with the distal end portion 202 of the pressing member 200.

In this manner, the sheet of paper T of A3 vertical-length passes between the stacking surface portion 520 and the pressing member 200 and is conveyed in the discharging direction D1. The distal end portion 202 of the pressing member 200 is in contact with the upper surface of the sheet of paper T in proximity to the first protruding portion 523. Therefore, the pressing member 200 can deform the sheet of paper T of A3 vertical-length, which is conveyed in the discharging direction D1, along the first protruding portion 523.

In particular, the pressing member 200 causes the sheet of paper T, which is conveyed diagonally upward by the first upward slope 523A upstream of the first protruding portion 523, to come in contact with the pressing member 200 downstream of the first protruding portion 523. In this manner, the pressing member 200 pushes the sheet of paper T to move along the first downward slope 523B downstream of the first protruding portion 523. Accordingly, the pressing member 200 can cause the sheet of paper T stacked on the stacking surface portion 520 to be more deformed along the protruding portion 522.

Thereafter, the sheet of paper T of A3 vertical-length is conveyed in the discharging direction D1 by the pair of discharging and reversing rollers 55. The distal end of the sheet of paper T of A3 vertical-length is conveyed diagonally upward along the second upward slope 524A of the second protruding portion 524 at the downstream end of the stacking surface portion 520 in the discharging direction D1.

Thereafter, as illustrated in FIG. 6G, the sheet of paper T of A3 vertical-length that is subjected to simplex printing is stacked at a predetermined position in the discharging direction D1 on the stacking surface portion 520. In this manner, simplex printing on the sheet of paper T contained in the sheet cassette 52 is completed.

In a state in which the sheet of paper T of A3 vertical-length that is subjected to simplex printing is stacked on the stacking surface portion 520, the sheet of paper T is deformed to have an upwardly convex projection in proximity to the first protruding portion 523 in the discharging direction D1. In addition, the sheet of paper T is deformed to incline upwardly in proximity to the second protruding portion 524. In this manner, it is possible to implement a configuration in which a sheet of paper T of A3 vertical-length that is the maximum size can be stacked by deforming the sheet of paper T in the vertical direction, without increasing the length of the stacking surface portion 520 in the discharging direction D1 and the height of the stacking space portion 540 in the vertical direction Z. As a result, it is possible to prevent an increase in the size of the device.

Since the second protruding portion 524 is formed adjacent to the end of the stacking surface portion 520, it is possible to stably deform the distal end of a sheet of paper T to incline upwardly.

When simplex printing is executed on a sheet of paper T stacked on the manual tray 65, the sheet of paper T is fed out to the manual paper path La by the paper feeding roller 66. Thereafter, the sheet of paper T is conveyed to the pair of registration rollers 80 through the first junction P1 and the first paper path L1. Subsequent operations are the same as those operations for simplex printing of a sheet of paper T that is contained in the sheet cassette 52 as described above, and therefore such description will not be repeated.

Next, the operation of the copy machine 1 for duplex printing will be described.

When simplex printing is performed, as described above, a sheet of paper T subjected to simplex printing is discharged from the first discharging portion 50*a* to the inner accumulation portion 510. In this manner, the printing operation is completed.

In contrast, when duplex printing is performed, a sheet of paper T that has been subjected to simplex printing is turned over by the pair of discharging and reversing rollers 55 and then re-conveyed back to the pair of registration rollers 80 in a state in which the front and back surfaces are reversed with respect to those during simplex printing. In this manner, duplex printing is performed on the sheet of paper T.

More particularly, the operations until the step in which the sheet of paper T that has been simplex printed is conveyed to the first discharging portion 50*a* through the third paper path L3 are the same as the operations described above in relation to simplex printing.

During duplex printing, a sheet of paper T of A3 vertical-length that has been printed on one surface is conveyed to the first discharging portion 50*a*. Then, the sheet of paper T of A3 vertical-length is partially fed out from the first discharging portion 50*a* to the stacking space portion 540 of the inner accumulation portion 510 and subsequently turned over by the pair of discharging and reversing rollers 55.

In the present embodiment, when the sheet of paper T of A3 vertical-length is partially fed out and turned over in the stacking space portion 540 by the pair of discharging and reversing rollers 55, the distal end of the sheet of paper T of A3 vertical-length reaches the pressing member 200. For this reason, the sheet of paper T conveyed in the discharging direction D1 passes between the uppermost sheet of sheets of paper T stacked on the stacking surface portion 520 and the pressing member 200 in the same manner as simplex printing as described above. The sheet of paper T is conveyed in the discharging direction D1 in a state in which the upper surface of the sheet of paper T is in contact with the distal end portion 202 of the pressing member 200. The operation to this point in duplex printing is the same as the simplex printing, and therefore detailed description will not be repeated.

When the sheet of paper T of A3 vertical-length passes between a sheet of paper T stacked on the stacking surface portion 520 and the pressing member 200 and advances by a predetermined distance in the discharging direction D1, the conveyance direction is switched to a return direction D2.

In this manner, the sheet of paper T of A3 vertical-length retained by the pair of discharging and reversing rollers 55 is conveyed in the return direction D2 by the pair of discharging and reversing rollers 55.

Thereafter, the sheet of paper T of A3 vertical-length conveyed in the return direction D2 is conveyed in an opposite direction in the third paper path L3 (the direction from the first discharging portion 50*a* towards the first branch portion Q1).

When the sheet of paper T of A3 vertical-length is conveyed in the third paper path L3 in the opposite direction, the sheet of paper T is guided to the reverse paper path Lb by the branching member 58. Thereafter, the sheet of paper T is guided into the first paper path L1 through the second junction P2. Herein, the front and back surfaces of the sheet of paper T have been turned over, differing from simplex printing.

Furthermore, the sheet of paper T is adjusted and corrected by the pair of registration rollers 80. The sheet of paper T is guided between the intermediate transfer belt 7 and the secondary transfer roller 8 through the first paper path L1. The unprinted surface of the sheet of paper T faces the intermediate transfer belt 7 as a result of passing through the reverse paper path Lb. Accordingly, a toner image is transferred onto the unprinted surface of the sheet of paper T. Consequently, duplex printing is performed on the sheet of paper T.

Thereafter the sheet of paper T that has been duplex printed is discharged from the first discharging portion 50*a* to the inner accumulation portion 510. This completes the printing operation.

The following effects are obtained according to the first embodiment, for example.

The copying machine 1 according to the present embodiment includes the first discharging portion 50*a*, the inner accumulation portion 510 and the pressing member 200. The first discharging portion 50*a* discharges a sheet of paper T with an image formed by the image forming portion GK. The sheet of paper T discharged from the first discharging portion 50*a* is stacked in the inner accumulation portion 510. The inner accumulation portion 510 includes a stacking surface portion 520 that has a planar portion 521 formed flat and a first protruding portion 523 formed to project upwardly from the planar portion. The pressing member 200 is disposed in contact with an upper surface of the sheet of paper T stacked on the stacking surface portion 520.

Accordingly, it is possible to deform the sheet of paper T stacked on the stacking surface portion 520 along the first protruding portion 523 in the vertical direction. In this manner, it is possible to implement the configuration in which the sheet of paper T that extends in the discharging direction D1 is stacked on the stacking surface portion 520 without increasing the length of the stacking surface portion 520 in the discharging direction D1 and the height of the stacking space portion 540 in the perpendicular direction (vertical direction) Z. As a result, it is possible to inhibit an increase in the size of the device. Consequently, it is possible to realize downsizing and economizing of space in relation to the device.

The inner accumulation portion 510 in the copying machine 1 according to the present embodiment includes the restriction wall 550. The restriction wall 550 is disposed to face the distal end of the sheet of paper T stacked on the stacking surface portion 520 in the discharging direction D1. The restriction wall 550 restricts the sheet of paper T stacked on the stacking surface portion 520 from moving in the discharging direction D1. The length from the end on the side closer to the first discharging portion 50*a* to the restriction wall 550 of the virtual surface (the flat surface without the first protruding portion 523, the second protruding portion 524 and the third protruding portion 525 on the stacking surface portion 520) in the discharging direction D1 is less than the length of the sheet of paper T in the discharging direction D1. The length along the surface of the stacking surface portion 520 including the first protruding portion 523 from the end on the side closer to the first discharging portion 50*a* to the restriction wall 550 in the discharging direction D1 is equal to or greater than the length of the sheet of paper T in the discharging direction D1.

As a result, even when the length of the virtual surface on the stacking surface portion 520 in the discharging direction D1 is shorter than the sheet of paper T of maximum size, this sheet of paper T can be stacked on the stacking surface portion 520 by deforming the sheet of paper T in the vertical direction by using the first protruding portion 523. In this manner, it is possible to stack the sheet of paper T of maximum size on the stacking surface portion 520 while preventing an increase in the dimensions of the device.

Furthermore, the pressing member 200 in the copying machine 1 according to the present embodiment is disposed in contact with the upper surface of the sheet of paper T stacked on the stacking surface portion 520 in proximity to the first protruding portion 523. The pressing member 200 is disposed in contact with the upper surface of the sheet of paper T stacked on the stacking surface portion 520, while deforming the sheet of paper T along the first protruding portion 523, compared with a state in which the pressing member 200 is not contact with the upper surface of the sheet of paper T stacked on the stacking surface portion 520. In this manner, it is possible to cause the sheet of paper T stacked on the stacking surface portion 520 to be more deformed along the first protruding portion 523. As a result, it is possible to further inhibit an increase in the size of the device.

The pressing member 200 is configured to be in contact with the upper surface of the sheet of paper T in proximity to the first protruding portion 523. As a result, even when the sheet of paper T exhibits high rigidity, it is possible to cause the sheet of paper T to be deformed along the first protruding portion 523.

The pressing member 200 in the copying machine 1 according to the present embodiment is disposed in contact with the upper surface of the sheet of paper T stacked on the stacking surface portion 520, more downstream than the first protruding portion 523 in the discharging direction D1. As a result, the pressing member 200 pushes the sheet of paper T, which is conveyed diagonally upward by the first upward slope 523A upstream of the first protruding portion 523, to move along the first downward slope 523B downstream of the first protruding portion 523. In this manner, it is possible to cause the sheet of paper T stacked on the stacking surface portion 520 to be more deformed along the first protruding portion 523.

In the copying machine 1 according to the present embodiment, the stacking surface portion 520 is disposed at a lower portion of the inner accumulation portion 510 in the vertical direction Z. The inner accumulation portion 510 further includes the stacking top surface portion 530 facing the stacking surface portion 520 in the vertical direction Z, and the stacking space portion 540 between the stacking surface portion 520 and the stacking top surface portion 530. The base portion 201 of the pressing member 200 is rotatably attached to the stacking top surface portion 530. The distal end portion 202 of the pressing member 200 is configured as a free end, and is disposed in contact with the upper surface of the sheet of paper T stacked on the stacking surface portion 520. The pressing member 200 allows the sheet of paper T that moves to be stacked on the stacking surface portion 520 by rotating the distal end portion 202 to move in a direction opposite to the first discharging portion 50*a*. Subsequently, the pressing member 200 comes in contact with the upper surface of the sheet of paper T that is allowed to move, and deforms the sheet of paper T.

The pressing member 200 rotating in this manner not only allows the sheet of paper T to move in the discharging direction D1, but also comes in contact with the upper surface of the sheet of paper T thus allowed to move. Accordingly, the pressing member 200 does not interfere with stacking of the sheet of paper T discharged from the first discharging portion 50*a* onto the stacking surface portion 520. Furthermore, the pressing member 200 comes in contact with the upper surface of the sheet of paper T, thereby deforming the sheet of paper T along the first protruding portion 523.

The copying machine 1 according to the present embodiment further includes the image reading unit 301 disposed at the upper portion of the case member BD. The stacking top surface portion 530 is configured by the lower portion of the image reading unit 301. Consequently, the pressing member 200 can be attached to the lower portion of the image reading unit 301. In this manner, it is possible to simply dispose the pressing member 200 in the stacking space portion 540. Accordingly, it is possible that the distal end portion 202 of the pressing member 200 simply comes in contact with the upper surface of the sheet of paper T stacked on the stacking surface portion 520. Therefore, it is possible to realize the simple configuration of disposing the pressing member 200.

The stacking space portion 540 is a space that is limited in the vertical direction Z. For example, it may be possible that the entirety of the stacking surface portion 520 is composed of a flat surface having an inclination. However, if the length along the surface of the stacking surface portion 520 in the discharging direction D1 is realized by the flat surface having an inclination, it will lead to an increase in the dimensions of the device in the vertical direction Z. In contrast, it is possible for the present disclosure to deform the sheet of paper T in the vertical direction by the first protruding portion 523, even when the stacking space portion 540 is a space limited in the vertical direction Z. As a result, it is possible to inhibit an increase in the size of the device.

A second embodiment will be described with reference to the figures as another embodiment of an image forming apparatus 1 according to the present disclosure. Those components that are the same as the first embodiment will be denoted by the same reference numerals in the description of the second embodiment, and the corresponding description will be omitted or simplified.

Figure 7:
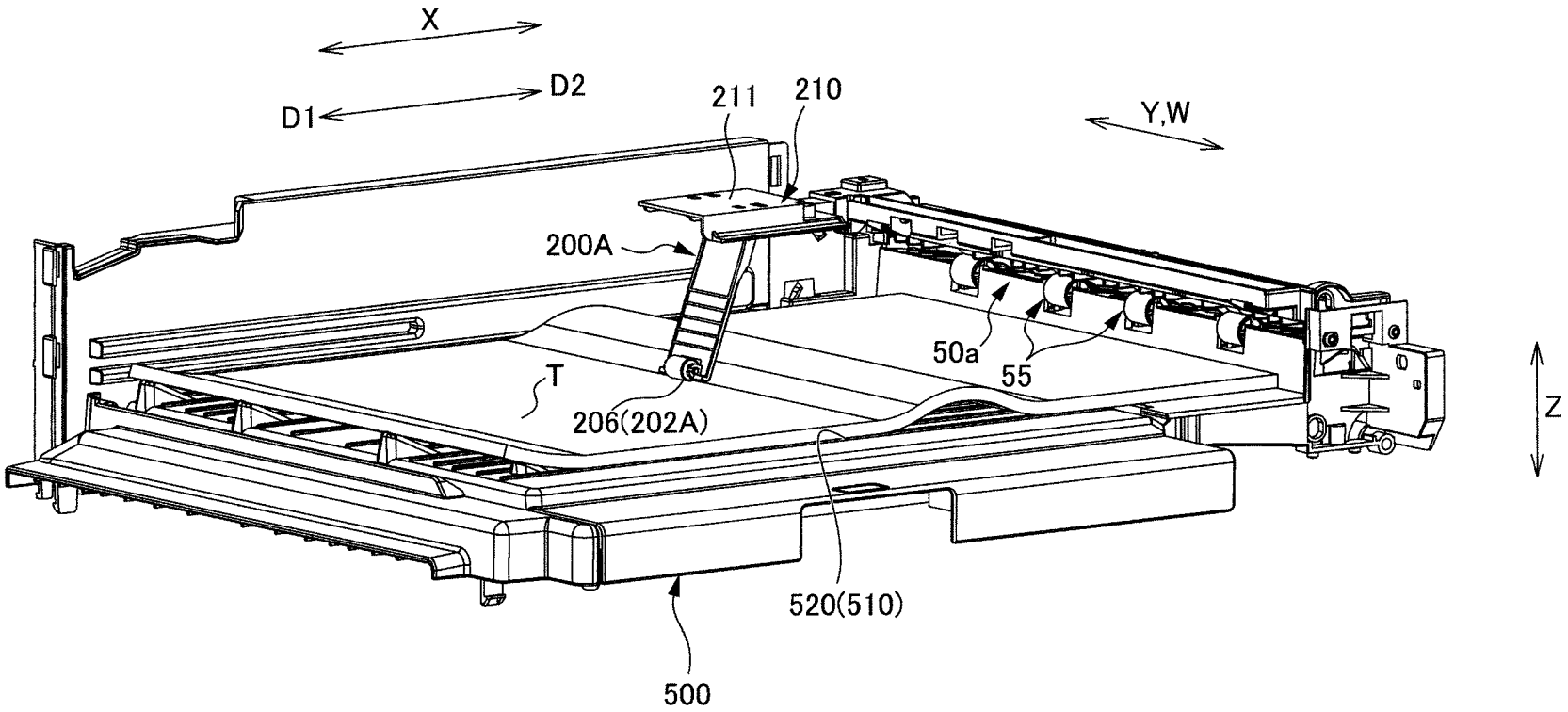
FIG. 7 is a perspective view illustrating the configuration of a pressing member 200A according to a second embodiment.

FIG. 7 is a perspective view illustrating the configuration of a pressing member 200A according to the second embodiment. In comparison to the first embodiment, the principal difference of the copying machine 1 according to the second embodiment is the configuration of a distal end portion 202A of the pressing member 200A.

As illustrated in FIG. 7, a portion of the distal end portion 202A of the pressing member 200A according to the second embodiment, which comes in contact with an upper surface of a sheet of paper T, includes a cylindrical roller 206 that acts as a rotating member. The roller 206 rotates about a rotation axis that extends in a paper width direction W and is provided at the distal end portion 202A. In this manner, the roller 206 rotates in contact with the upper surface of the conveyed sheet of paper T. The roller member 206 at the distal end portion 202A causes the distal end portion 202A of the pressing member 200A to be in contact with the upper surface of the sheet of paper T in a state of low frictional resistance.

In addition to the same effects as the first embodiment, the copying machine 1 according to the second embodiment obtains the following effects.

In the second embodiment, the portion of the distal end portion 202A of the pressing member 200A, which comes in contact with the upper surface of the sheet of paper T, includes the roller 206. Accordingly, the roller 206 rotates in contact with the upper surface of the conveyed sheet of paper T. As a result, the frictional resistance between the distal end portion 202A (roller 206) of the pressing member 200A and the sheet of paper T is reduced. In this manner, when the sheet of paper T is stacked onto a stacking surface portion 520, it is possible to inhibit a rear end of the sheet of paper T from remaining in a pair of discharging and reversing rollers 55. When the sheet of paper T is conveyed in a return direction D2 in contact with the distal end portion 202A of the pressing member 200A for reversing the sheet of paper T during duplex printing, it is possible to inhibit the sheet of paper T from catching on the pressing member 200A.

A third embodiment will be described with reference to the figures as another embodiment of an image forming apparatus 1 according to the present disclosure. Those components that are the same as the first embodiment will be denoted by the same reference numerals in the description of the third embodiment and the corresponding description will be omitted or simplified.

Figure 8:
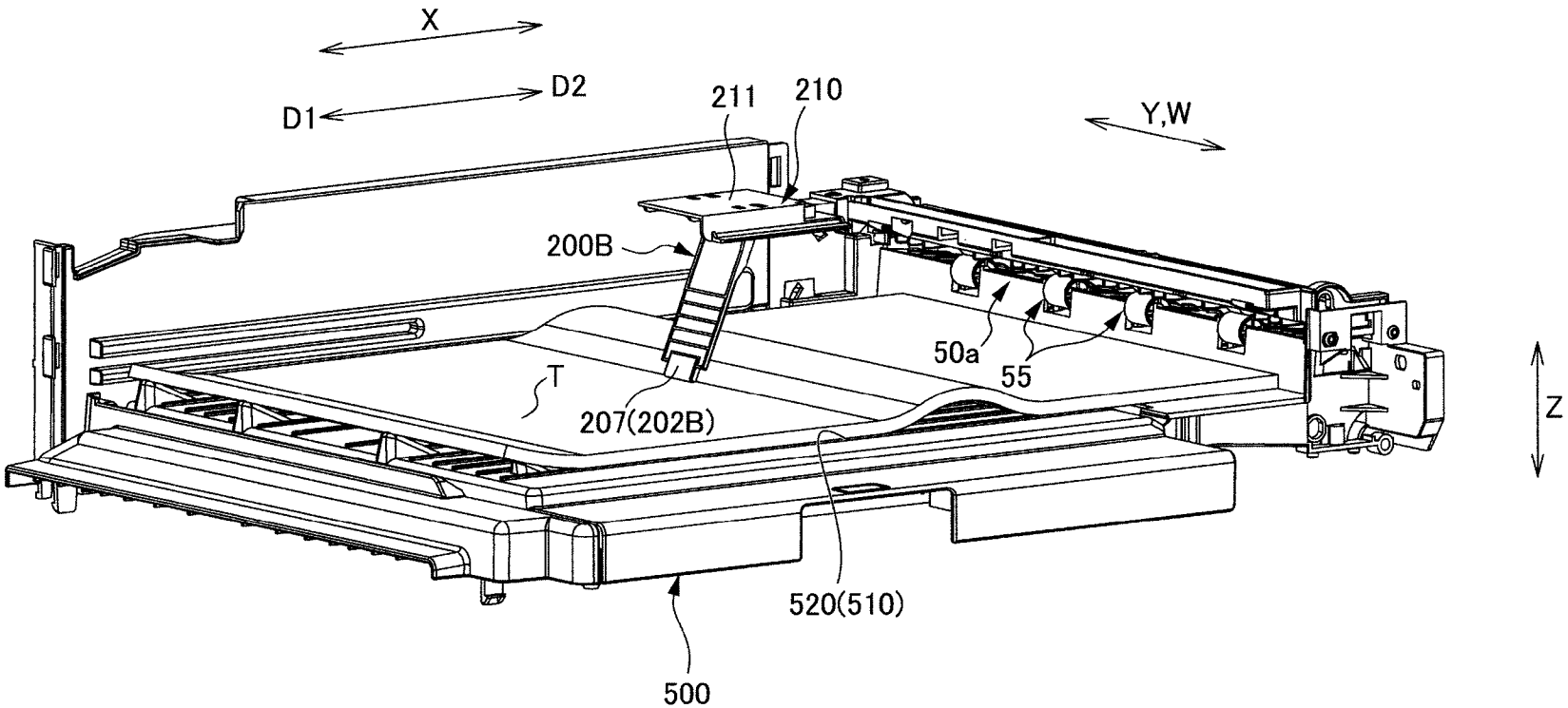
FIG. 8 is a perspective view illustrating the configuration of a pressing member 200B according to a third embodiment.

FIG. 8 is a perspective view illustrating the configuration of a pressing member 200B according to the third embodiment. In comparison to the first embodiment and the second embodiment, the principal difference of the copying machine 1 according to the third embodiment is the configuration of a distal end portion 202B of the pressing member 200B.

As illustrated in FIG. 8, a portion of the distal end portion 202B of the pressing member 200B according to the third embodiment, which comes in contact with an upper surface of a sheet of paper T, includes a sheet member 207 that exhibits a low frictional coefficient. In this manner, the distal end portion 202B of the pressing member 200B is in contact with the upper surface of the sheet of paper T in a low frictional resistance.

The copying machine 1 according to the third embodiment obtains the same effects as the second embodiment.

More specifically, the portion of the distal end portion 202B of the pressing member 200B, which comes in contact with the upper surface of the sheet of paper T, includes the sheet member 207. Accordingly, it is possible to reduce the frictional resistance between the distal portion 202B (sheet member 207) of the pressing member 200B and the sheet of paper T, similarly with the second embodiment. In this manner similarly with the second embodiment, when the sheet of paper T is stacked onto the stacking surface portion 520, it is possible to inhibit a rear end of the sheet of paper T from remaining in a pair of discharging and reversing rollers 55. Furthermore, when the sheet of paper T is conveyed in a return direction D2 in contact with the distal end portion 202B of the pressing member 200B for reversing the sheet of paper T during duplex printing, it is possible to inhibit the sheet of paper T from catching on the pressing member 200B.

A fourth embodiment will be described with reference to the figures as another embodiment of an image forming apparatus 1 according to the present disclosure. Those components that are the same as the first embodiment and the second embodiment will be denoted by the same reference numerals in the description of the fourth embodiment, and the corresponding description will be omitted or simplified.

Figure 9:
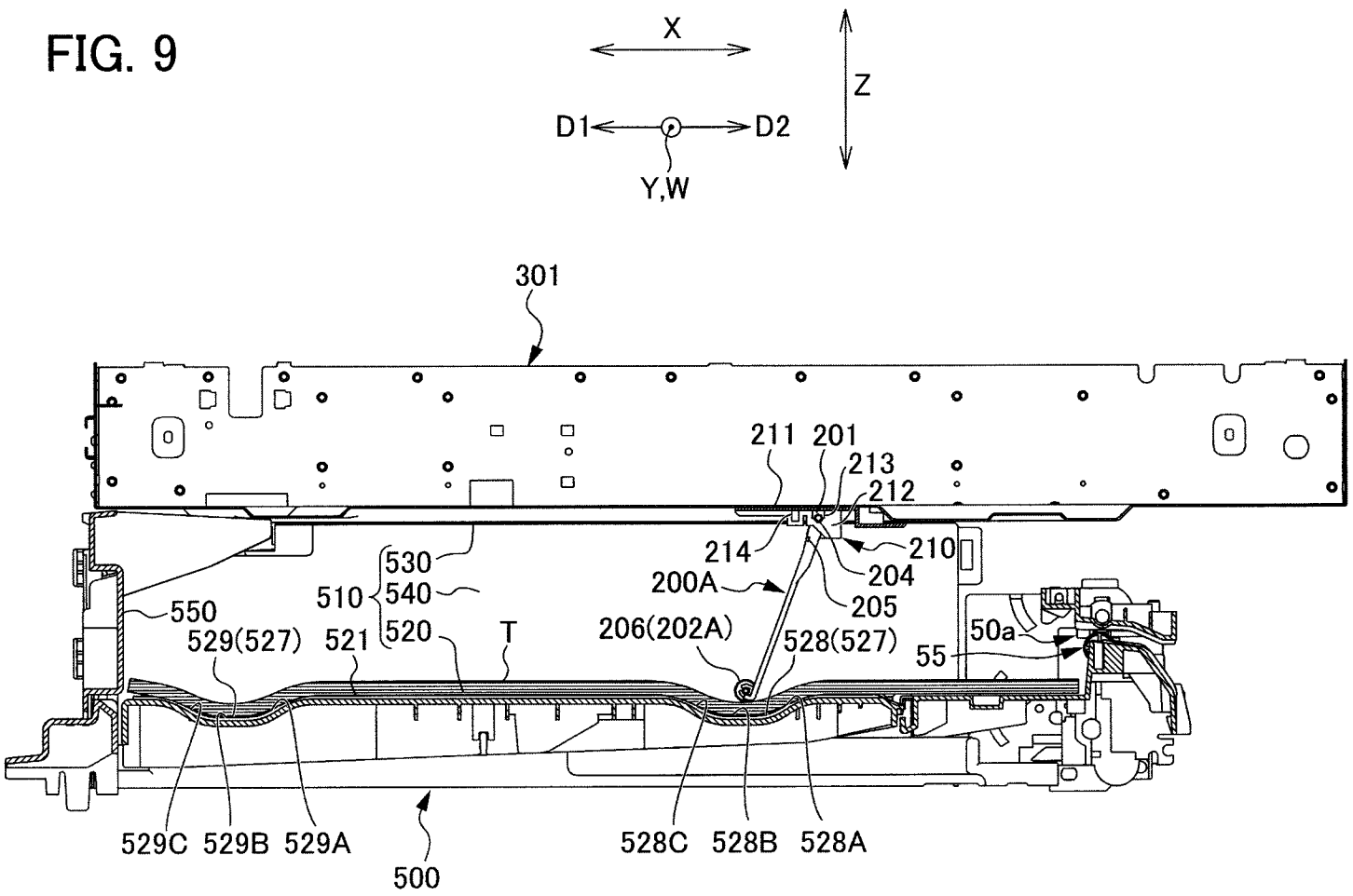
FIG. 9 is a side view illustrating the configuration of the pressing member 200A and an inner accumulating portion 510A according to a fourth embodiment.
Figure 10:
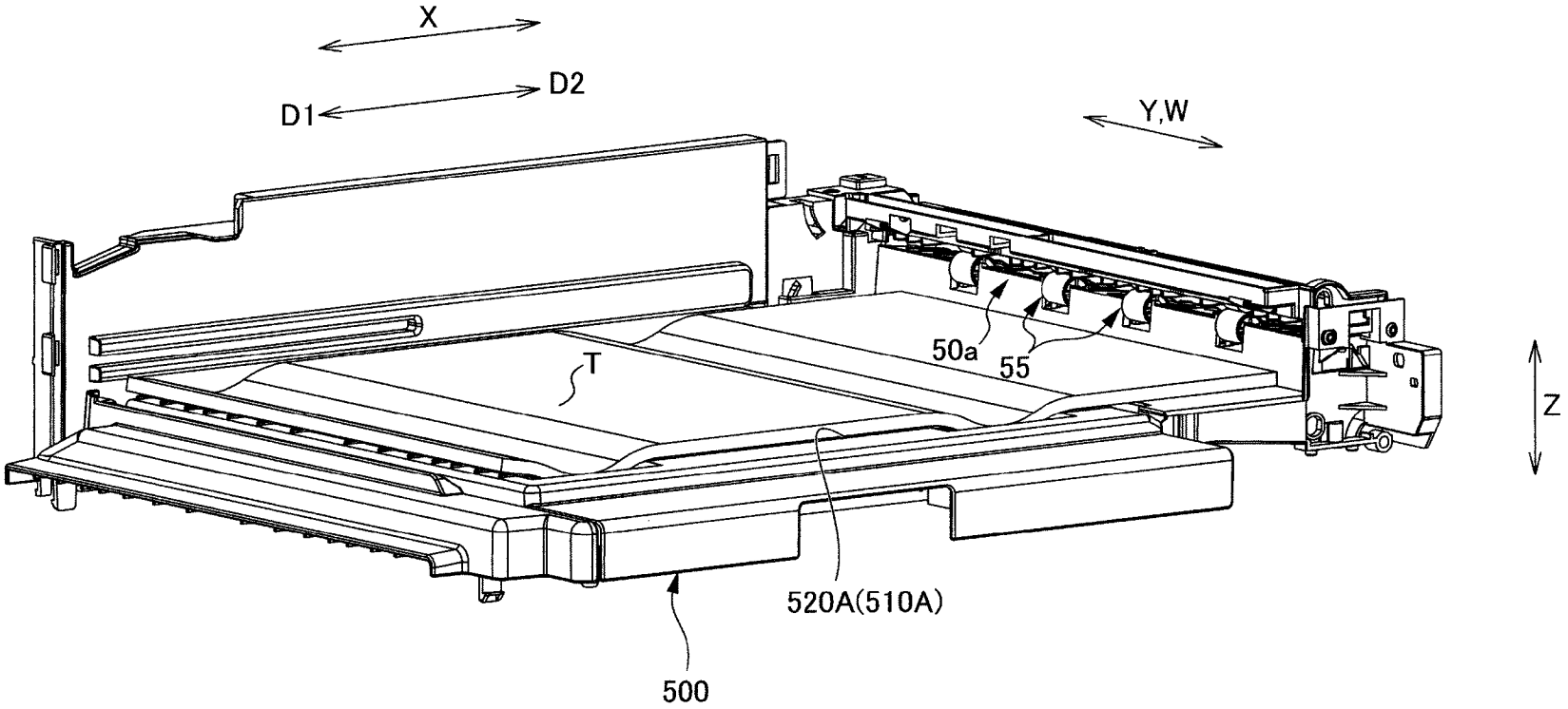
FIG. 10 is a perspective view illustrating the configuration of a stacking surface portion 520A with sheets of paper T stacked according to the fourth embodiment.
Figure 11:
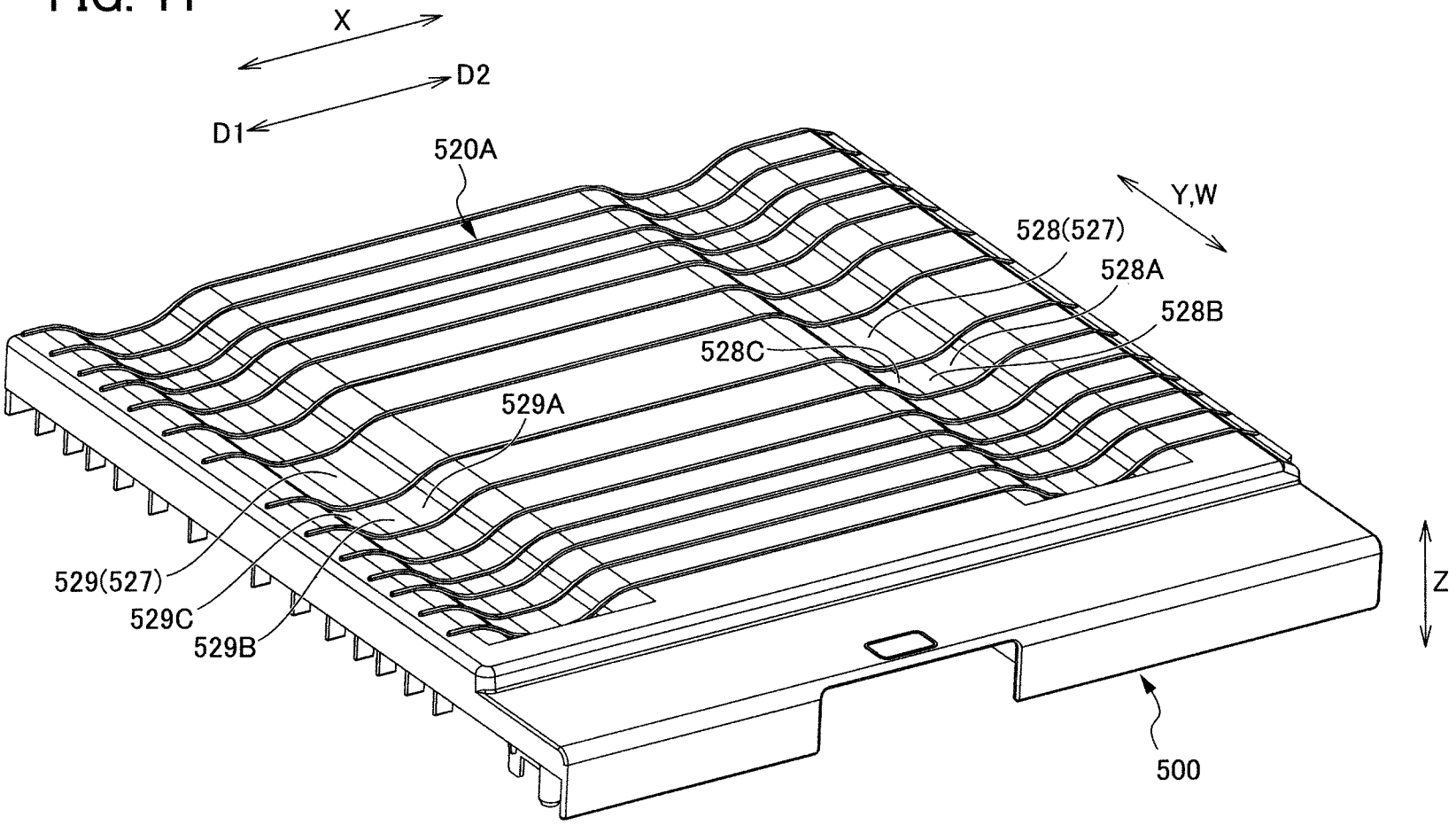
FIG. 11 is a perspective view illustrating the configuration of the stacking surface portion 520A without the sheets of paper T stacked according to the fourth embodiment.

FIG. 9 is a side view illustrating the configuration of a pressing member 200A and an inner accumulating portion 510A according to the fourth embodiment. FIG. 10 is a perspective view illustrating the configuration of a stacking surface portion 520A on which sheets of paper T are stacked according to the fourth embodiment. FIG. 11 is a perspective view illustrating the configuration of the stacking surface portion 520A on which sheets of paper T are not stacked according to the fourth embodiment.

The copying machine 1 according to the fourth embodiment differs from the copying machine 1 according to the first embodiment mainly in that there is no protruding portion 522 and there is a recessed portion 527. In the copying machine 1 according to the fourth embodiment, a portion of a distal end portion 202 that comes in contact with a sheet of paper T includes a roller 206 of the second embodiment.

As illustrated in FIGS. 9 to 11, a stacking surface portion 520A according to the fourth embodiment includes a planar portion 521 and a plurality of recessed portions 527. The planar portion 521 is formed flat. The plurality of recessed portions 527 is formed to be recessed downwardly in a vertical direction Z at the planar portion 521. The plurality of recessed portions 527 is each formed in a shape of a valley having a bottom when viewed in a paper width direction W.

The plurality of recessed portions 527 includes one first recessed portion 528 and one second recessed portion 529. The one first recessed portion 528 is formed at the recessed surface portion 520 upstream in the discharging direction D1. The one second recessed portion 529 is formed at the recessed surface portion 520 downstream in the discharging direction D1.

The first recessed portion 528 and the second recessed portion 529 have the same shape and only differ from each other in their positions with respect to the discharging direction D1. The first recessed portion 528 and the second recessed portion 529 are formed to extend across the whole area in the paper width direction W.

The first recessed portion 528 is formed to extend across the whole area in the paper width direction W more upstream than the center of the stacking surface portion 520A in the discharging direction D1. The first recessed portion 528 includes a first upstream slope 528A, a first bottom surface 528B, and a first downstream slope 528C that are sequentially formed from upstream to downstream in the discharging direction D1.

The first bottom surface 528B is a horizontal bottom surface that is formed at the most recessed position of the first recessed portion 528. The first upstream slope 528A inclines downwardly from upstream to downstream of the discharging direction D1. The first downstream slope 528C inclines upwardly from upstream to downstream of the discharging direction D1.

The second recessed portion 529 is formed at the downstream end of the stacking surface portion 520A in the discharging direction D1 across the whole area in the paper width direction W. The second recessed portion 529 includes a second upstream slope 529A, a second bottom surface 529B, and a second downstream slope 529C that are sequentially formed from upstream to downstream in the discharging direction D1.

The second bottom surface 529B is a horizontal bottom surface that is formed at the most recessed position of the second recessed portion 529. The second upstream slope 529A inclines downwardly from upstream to downstream of the discharging direction D1. The second downstream slope 529C inclines upwardly from upstream to downstream in the discharging direction D1.

The roller 206 of the pressing member 200A is disposed to face the first bottom surface 528B of the first recessed portion 528. The roller 206 is disposed in contact with an upper surface portion of a sheet of paper T corresponding to the first bottom surface 528B, the sheet of paper T being stacked on the stacking surface portion 520.

The copying machine 1 according to the fourth embodiment obtains the same effect as the first embodiment and the second embodiment.

More specifically, the roller 206 of the distal end portion 202A of the pressing member 200A comes in contact with the upper surface portion of the sheet of paper T corresponding to the first recessed portion 528, the sheet of paper T being stacked on the stacking surface portion 520. Consequently, the roller 206 can deform the sheet of paper T stacked on the stacking surface portion 520 along the recessed portion 528. In this manner, it is possible that the pressing member 200A deforms the sheet of paper T stacked on the stacking surface portion 520A in a vertical direction Z. As a result, it is possible to inhibit an increase in the size of the device.

Although the preferred embodiments have been described above, the present disclosure is not limited to the embodiments described above and may be executed in various configurations.

For example, in the first embodiment described above, the stacking surface portion 520 includes the protruding portion 522. In the fourth embodiment, the stacking surface portion 520A includes the recessed portion 527. However, the disclosure is not limited to such examples, and may include both the protruding portion 522 and the recessed portion 527 at the same time.

In the embodiments above, although the plurality of protruding portions 522 or the plurality of recessed portions 527 is described as an example, the disclosure is not limited to such an example. For example, it may be alternatively possible that there is only one protruding portion 522 or only one recessed portion 527.

Furthermore, in the first embodiment above, the pressing member 200 is disposed in contact with the upper surface of the sheet of paper T more downstream than the first protruding portion 523 in the discharging direction D1 as an example. However, the disclosure is not limited to such an example. It may be alternatively possible that the pressing member 200 is disposed in contact with the upper surface of the sheet of paper T more upstream than the first protruding portion 523 in the discharging direction D1 or at a portion corresponding to the first protruding portion 523.

In the embodiments above, although the pressing member 200 is formed flat as an example, the disclosure is not limited to such an example. It may be alternatively possible that the pressing member 200 is formed in a curved shape.

In the embodiments above, although the planar portion 521 of the stacking surface portion 520 is formed horizontal as an example, the disclosure is not limited to such an example. It may be alternatively possible that the planner portion 521 is formed diagonal.

The type of image forming apparatus according to the present disclosure is not limited and may include a copying machine, a printer, a facsimile, or a multifunction peripheral combining such devices.

Furthermore, the sheet medium is not limited to paper, and for example, may include a film sheet.

What is claimed is:

1. An image forming apparatus comprising:

a housing;

an image forming unit disposed inside the housing;

a discharging portion configured to discharge a sheet medium on which an image is formed by the image forming unit;

a stacking unit configured to stack the sheet medium discharged from the discharging portion, the stacking unit including a stacking surface portion on which the sheet medium is stacked, the stacking surface portion including a planar portion formed flat and a recessed portion configured to be indented downwardly at the planar portion over an entirety thereof with respect to a sheet medium width direction; and a pressing member disposed in contact with an upper surface of the sheet medium stacked on the stacking surface portion, wherein the stacking unit comprises a restriction portion disposed to face a distal end of the sheet medium that is stacked on the stacking surface portion in a discharging direction in which the sheet medium is discharged from the discharging portion, the restriction portion configured to restrict the sheet medium stacked on the stacking surface portion from moving in the discharging direction, a length in the discharging direction from an end on a side closer to the discharging portion of a virtual surface to the restriction portion is less than a length of the sheet medium in the discharging direction the virtual surface being a flat surface without the recessed portion at the stacking surface portion, and a length along a surface on the stacking surface portion including the recessed portion in the discharging direction from the end on the side closer to the discharging portion to the restriction portion is equal to or greater than the length of the sheet medium in the discharging direction.

2. The image forming apparatus according to claim 1, wherein the pressing member is disposed in contact with an upper surface region of the sheet medium stacked on the stacking surface portion, the upper surface region corresponding to the recessed portion.

3. The image forming apparatus according to claim 1, wherein a portion of the pressing member that comes in contact with the upper surface of the sheet medium comprises a rotating member configured to rotate in contact with the upper surface of the sheet medium.

4. An image forming apparatus comprising:

a housing;

an image forming unit disposed inside the housing;

a discharging portion configured to discharge a sheet medium on which an image is formed by the image forming unit;

a stacking unit configured to stack the sheet medium discharged from the discharging portion, the stacking unit including a stacking surface portion on which the sheet medium is stacked, the stacking surface portion including a planar portion formed flat and a recessed portion configured to be indented downwardly at the planar portion over an entirety thereof with respect to a sheet medium width direction; and a pressing member disposed in contact with an upper surface of the sheet medium stacked on the stacking surface portion, wherein the stacking surface portion is disposed in a vertically lower portion of the stacking unit, the stacking unit further includes a top surface portion disposed vertically opposite to the stacking surface portion, and a stacking space portion between the stacking surface portion and the top surface portion, one end of the pressing member is rotatably attached to the top surface portion, the other end of the pressing member is disposed as a free end in contact with the upper surface of the sheet medium stacked on the stacking surface portion, and the other end of the pressing member rotates to move in a direction opposite to the first discharging portion, thereby allowing the sheet medium to move to be stacked on the stacking surface portion, and deforms the sheet medium that is allowed to move by coming in contact with the upper surface of the sheet medium.

5. The image forming apparatus according to claim 4, further comprising an image reading unit disposed on an upper portion of the housing, wherein the top surface portion comprises a lower portion of the image reading unit.

* * * * *